US010503091B2

(12) United States Patent
Tsurumi et al.

(10) Patent No.: US 10,503,091 B2
(45) Date of Patent: Dec. 10, 2019

(54) CARRIER FOR ELECTROSTATIC IMAGE DEVELOPMENT AND ELECTROSTATIC IMAGE DEVELOPER

(71) Applicant: FUJI XEROX CO., LTD., Tokyo (JP)

(72) Inventors: Yosuke Tsurumi, Kanagawa (JP); Moegi Iguchi, Kanagawa (JP); Shintaro Anno, Kanagawa (JP); Toshiaki Hasegawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/120,457

(22) Filed: Sep. 4, 2018

(65) Prior Publication Data

US 2019/0286000 A1 Sep. 19, 2019

(30) Foreign Application Priority Data

Mar. 13, 2018 (JP) ..... 2018-045934

(51) Int. Cl.
*G03G 9/08* (2006.01)
*G03G 9/107* (2006.01)
*G03G 9/113* (2006.01)

(52) U.S. Cl.
CPC ..... *G03G 9/1075* (2013.01); *G03G 9/0819* (2013.01); *G03G 9/0827* (2013.01); *G03G 9/1133* (2013.01); *G03G 9/1139* (2013.01)

(58) Field of Classification Search
CPC ... G03G 9/1075; G03G 9/1139; G03G 9/1133
USPC ..... 430/111.35
See application file for complete search history.

(56) References Cited

U.S. PATENT DOCUMENTS

| | | | | |
|---|---|---|---|---|
| 8,663,892 | B2 | 3/2014 | Yaguchi et al. | |
| 2007/0092306 | A1* | 4/2007 | Matsuura | G03G 15/0813 399/267 |
| 2018/0267416 | A1* | 9/2018 | Uchino | G03G 9/0825 |

FOREIGN PATENT DOCUMENTS

| | | |
|---|---|---|
| JP | H05323675 | 12/1993 |
| JP | 2010014854 | 1/2010 |
| JP | 2013057817 | 3/2013 |
| JP | 2013120281 | 6/2013 |

* cited by examiner

*Primary Examiner* — Mark A Chapman
(74) *Attorney, Agent, or Firm* — JCIPRNET

(57) ABSTRACT

A carrier for electrostatic image development includes: resin-coated magnetic particles each including a magnetic particle and a resin layer that covers the magnetic particle; and strontium titanate particles composed of primary particles having an average circularity of 0.82 to 0.94 and an 84% cumulative circularity of more than 0.92.

7 Claims, 4 Drawing Sheets

SW-360

CARRIER FOR ELECTROSTATIC IMAGE DEVELOPMENT AND ELECTROSTATIC IMAGE DEVELOPER

CROSS-REFERENCE TO RELATED APPLICATIONS

This application is based on and claims priority under 35 USC 119 from Japanese Patent Application No. 2018-045934 filed Mar. 13, 2018.

BACKGROUND

(i) Technical Field

The present disclosure relates to a carrier for electrostatic image development and to an electrostatic image developer.

(ii) Related Art

One known carrier for electrostatic image development is a resin-coated carrier including magnetic particles having a resin layer on their surface. For example, the following resin-coated carriers have been disclosed.

Japanese Unexamined Patent Application Publication No. 5-323675 discloses a magnetic material-dispersed carrier including: a core material containing a binder resin and fine magnetic material particles dispersed in the binder resin; and a resin containing a styrene-acrylic copolymer and covering the core material, wherein the fine magnetic material particles contain strontium ferrite, barium ferrite, or lead ferrite.

Japanese Unexamined Patent Application Publication No. 2013-120281 discloses a carrier including: a carrier core material composed of ferrite; and a resin layer that covers the carrier core material and contains fine strontium ferrite particles.

Japanese Unexamined Patent Application Publication No. 2013-057817 discloses a carrier including: magnetic core particles; and a coating layer that covers the core particles. The coating layer contains a resin and a filler, and the amount of the filler is 50 parts by mass to 500 parts by mass based on 100 parts by mass of the resin.

Japanese Unexamined Patent Application Publication No. 2010-014854 discloses a magnetic carrier including: a magnetic carrier core containing a magnetic material; and a coating layer that covers the surface of the magnetic carrier core, the coating layer being obtained by subjecting the magnetic carrier core to coating treatment with at least a binder resin and a fine inorganic powder. The fine inorganic powder contains at least strontium titanate.

SUMMARY

Aspects of non-limiting embodiments of the present disclosure relate to a carrier for electrostatic image development, the carrier including resin-coated magnetic particles and strontium titanate particles. With this carrier for electrostatic image development, the degree of fogging that occurs after repeated formation of high-density monochrome images is lower than that with a carrier for electrostatic image development in which the circularity when a cumulative frequency in an average circularity distribution of primary particles forming strontium titanate particles is 84% is 0.92 or less.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a carrier for electrostatic image development, the carrier including: resin-coated magnetic particles each including a magnetic particle and a resin layer that covers the magnetic particle; and strontium titanate particles composed of primary particles having an average circularity of 0.82 to 0.94 and an 84% cumulative circularity of more than 0.92.

BRIEF DESCRIPTION OF THE DRAWINGS

Exemplary embodiments of the present disclosure will be described in detail based on the following figures, wherein.

DETAILED DESCRIPTION

Figure 1A:
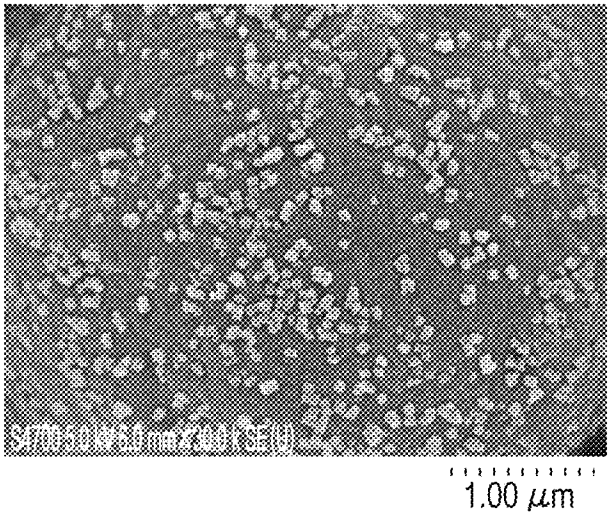
FIG. 1A shows an SEM image of a resin particle to which SW-360 manufactured by Titan Kogyo, Ltd., which is an example of strontium titanate particles, has been externally added and also shows a graph of the circularity distribution of the strontium titanate particles determined by analyzing the SEM image.
Figure 1A:
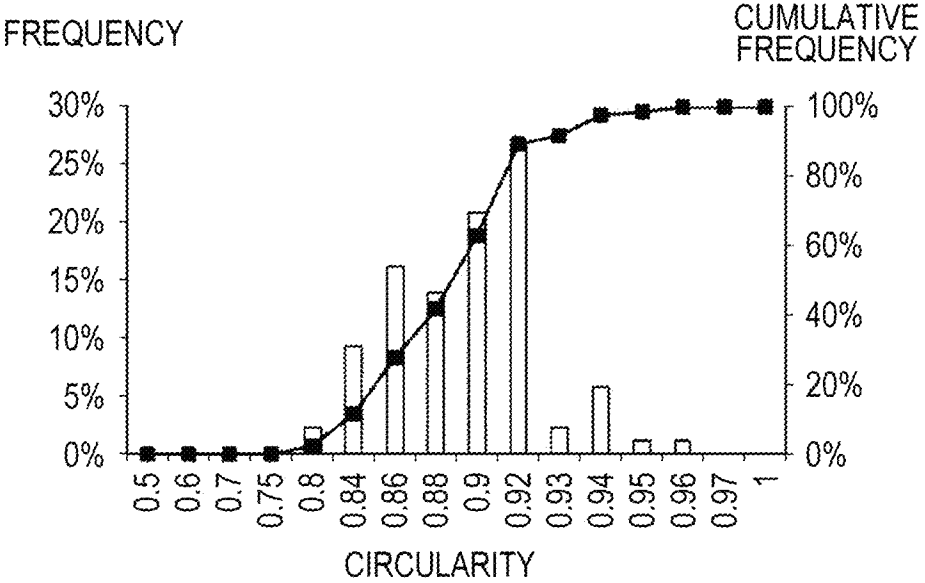

Exemplary embodiments of the disclosure will be described below. The description and Examples are illustrative of the exemplary embodiments and are not intended to limit the scope of the disclosure.

In the exemplary embodiments of the disclosure, when reference is made to the amount of a component in a composition, if the composition contains a plurality of materials corresponding to the above component, the above amount means the total amount of the plurality of materials, unless otherwise specified.

In the exemplary embodiments of the disclosure, a numerical range represented using "to" means a range including the numerical values before and after the "to" as the minimum value and the maximum value, respectively.

In the exemplary embodiments of the disclosure, a "carrier for electrostatic image development" may be referred to also as a "carrier," and a "toner for electrostatic image development" may be referred to also as a "toner." An "electrostatic image developer" may be referred to also as a "developer."

<Carrier for Electrostatic Image Development>

A carrier according to a first exemplary embodiment includes: resin-coated magnetic particles each including a magnetic particle and a resin layer that covers the magnetic particle; and strontium titanate particles.

In the carrier according to the first exemplary embodiment, the strontium titanate particles are composed of primary particles having an average circularity of 0.82 to 0.94 and an 84% cumulative circularity of more than 0.92.

In the first exemplary embodiment, the circularity of the primary particles forming the strontium titanate particles is in the above-described range. This means that the strontium titanate particles have a rounded shape (the details will be described later).

A carrier according to a second exemplary embodiment includes: resin-coated magnetic particles each including a magnetic particle and a resin layer that covers the magnetic particle; and strontium titanate particles.

In the strontium titanate particles in the carrier according to the second exemplary embodiment, the half width of a (110) peak obtained by an X-ray diffraction method is 0.2° to 2.0°.

In the second exemplary embodiment, the half width of the (110) peak of the strontium titanate particles is within the above-described range. This means that the strontium titanate particles have a rounded shape (the details will be described later).

In the following description, features common to the first and second exemplary embodiments will be described collectively as features in the present exemplary embodiment.

In the carrier according to the present exemplary embodiment, since the strontium titanate particles contained in the carrier have a rounded shape, the occurrence of fogging after repeated formation of high-density monochrome images may be prevented. Although this mechanism is not clearly understood, the mechanism of this effect is inferred as follows.

When, after repeated formation of a monochrome image with a high printing area ratio (e.g., a monochrome image with an image area of 20% or more of the area of printing paper), a low-density image of the same color as the previously formed images (e.g., fine lines such as characters) is formed, fogging (a phenomenon in which the toner adheres to a portion of an image-holding member which portion holds no electrostatic image and an unintended image appears on a recording medium) may occur. This is because of the following reason. When the formation of a monochrome image with a high printing are ratio is repeated, a large amount of the toner in the developing device is consumed, and the amount of the toner replenished increases. In this case, the toner is not sufficiently charged in the developing device, so the amount of charge on the toner decreases.

A carrier containing strontium titanate particles is a known art. The crystal structure of the strontium titanate particles is a perovskite structure, and the particles generally have a cubic or cuboidal shape. In the carrier including the resin-coated magnetic particles and the cubic or cuboidal strontium titanate particles added thereto, the strontium titanate particles adhere to the resin layer with their corner sticking into the resin layer and therefore may not be easily dispersed uniformly.

However, it is inferred that strontium titanate particles having a rounded shape can easily move on the surfaces of the resin-coated magnetic particles and are therefore dispersed uniformly. With the strontium titanate particles dispersed uniformly on the surfaces of the resin-coated magnetic particles, the carrier may have high surface uniformity, and the electric characteristics of the strontium titanate particles may allow the surface of the carrier to be strongly charged. With this carrier, insufficient charging of the toner in the developing device is prevented, and this may prevent the occurrence of fogging.

The structure of the carrier according to the present exemplary embodiment will be described in detail.

[Resin-Coated Magnetic Particles]

The resin-coated magnetic particles each include a magnetic particle and a resin layer that covers the magnetic particle.

[Magnetic Particles]

No particular limitation is imposed on the magnetic particles, and known magnetic particles used as a core material for carriers may be used. Specific examples of the magnetic particles include: magnetic metal particles such as iron particles, nickel particles, and cobalt particles; magnetic oxide particles such as ferrite particles and magnetite particles; resin-impregnated magnetic particles prepared by impregnating a porous magnetic powder with a resin; and magnetic powder-dispersed resin particles prepared by dispersing a magnetic powder in a resin.

In the present exemplary embodiment, ferrite particles are suitably used as the magnetic particles.

In the present exemplary embodiment, the ferrite particles may contain at least one selected from calcium oxide and strontium oxide. The calcium oxide and the strontium oxide tend to be contained on the surfaces of the ferrite particles. When the calcium element or the strontium element is present on the surfaces of the ferrite particles, leakage of electric charge from the ferrite particles may be prevented, and this may allow the surface of the carrier to be relatively strongly charged. With this carrier, insufficient charging of the toner in the developing device is prevented. In this case, the occurrence of fogging may be further prevented, and the reproducibility of fine lines may be improved (e.g., thickening, blurring, and smearing of fine lines may be prevented). This effect is remarkable when, after repeated formation of a high-density monochrome image at high speed, a low-density monochrome image of the same color as the previously formed images is formed.

In the present exemplary embodiment, the ferrite particles may contain at least one selected from calcium oxide and strontium oxide, and the total content of the calcium element and the strontium element may be 0.1% by mass to 2.0% by mass. When the total content of the calcium element and the strontium element in the ferrite particles is 0.1% by mass or more, leakage of electric charge from the ferrite particles may be efficiently reduced. When the total content of the calcium element and the strontium element in the ferrite particles is 2.0% by mass or less, the ferrite particles may have a well-defined crystal structure, and the resistance value and magnetic susceptibility of the ferrite particles may be within their suitable ranges. Therefore, the occurrence of fogging may be further prevented, and the reproducibility of fine lines may be improved (e.g., thickening, blurring, and smearing of fine lines may be prevented).

From the above point of view, the total content of the calcium element and the strontium element in the ferrite particles is preferably 0.1% by mass to 2.0% by mass, more preferably 0.2% by mass to 1.5% by mass, and still more preferably 0.5% by mass to 1.2% by mass.

In the present exemplary embodiment, the ferrite particles may contain calcium oxide, and the content of the calcium element with respect to the total mass of the ferrite particles may be 0.2% by mass to 2.0% by mass. When the content of the calcium element with respect to the total mass of the ferrite particles is 0.2% by mass or more, leakage of electric charge from the ferrite particles may be efficiently reduced. When the content of the calcium element with respect to the total mass of the ferrite particles is 2.0% by mass or less, the ferrite particles may have a well-defined crystal structure, and the resistance value and magnetic susceptibility of the ferrite particles may be within their suitable ranges. Therefore, the occurrence of fogging may be further prevented, and the reproducibility of fine lines is improved (e.g., thickening, blurring, and smearing of fine lines may be prevented).

From the above point of view, the content of the calcium element with respect to the total mass of the ferrite particles is preferably 0.2% by mass to 2.0% by mass, more preferably 0.5% by mass to 1.5% by mass, and still more preferably 0.5% by mass to 1.0% by mass.

In the present exemplary embodiment, the ferrite particles may contain strontium oxide, and the content of the strontium element with respect to the total mass of the ferrite particles may be 0.1% by mass to 1.0% by mass. When the content of the strontium element with respect to the total mass of the ferrite particles is 0.1% by mass or more, leakage of electric charge from the ferrite particles may be efficiently reduced. When the content of the strontium element with respect to the total mass of the ferrite particles is 1.0% by mass or less, the ferrite particles may have a well-defined crystal structure, and the resistance value and magnetic susceptibility of the ferrite particles may be within their suitable ranges. Therefore, the occurrence of fogging may be further prevented, and the reproducibility of fine lines may be improved (e.g., thickening, blurring, and smearing of fine lines may be prevented).

From the above point of view, the content of the strontium element with respect to the total mass of the ferrite particles is preferably 0.1% by mass to 1.0% by mass, more preferably 0.4% by mass to 1.0% by mass, and still more preferably 0.5% by mass to 0.8% by mass.

The contents of the calcium and strontium elements contained in the ferrite particles are measured by X-ray fluorescence analysis. The X-ray fluorescence analysis of the ferrite particles is performed by the following method.

An X-ray fluorescence analyzer (XRF1500 manufactured by Shimadzu Corporation) is used to perform qualitative analysis and quantitative analysis under the following conditions: X-ray power: 40 V/70 mA; measurement area: 10 mm in diameter; and measurement time: 15 minutes. Elements to be analyzed are selected from elements detected by the qualitative analysis. Iron (Fe), manganese (Mn), magnesium (Mg), calcium (Ca), strontium (Sr), oxygen (O), and carbon (C) may be selected. Calibration curve data produced separately is used to compute the mass ratio (%) of each element.

The volume average particle diameter of the magnetic particles is, for example, 10 μm to 500 μm, preferably 20 μm to 180 μm, and more preferably 25 μm to 60 μm.

As for the magnetic force of the magnetic particles, their saturation magnetization at a magnetic field of 3,000 oersted is, for example, 50 emu/g or more and preferably 60 emu/g or more. The saturation magnetization is measured using a vibrating sample magnetometer VSMP 10-15 (manufactured by TOEI INDUSTRY Co., Ltd.). The sample for the measurement is placed in a cell with an inner diameter of 7 mm and a height of 5 mm, and the cell is placed in the magnetometer. In the measurement, a magnetic field is applied and increased to a maximum of 3,000 oersted. Then the applied magnetic field is reduced to generate a hysteresis curve on a recording sheet. The saturation magnetization, residual magnetization, and coercive force of the sample are determined from the data about the curve.

The volume resistivity of the magnetic particles is, for example, $10^5$ Ω·cm to $10^9$ Ω·cm and preferably $10^7$ Ω·cm to $10^9$ Ω·cm.

The volume resistivity (Ω·cm) of the magnetic particles is measured as follows. A measurement object is placed on a surface of a circular jig with a 20 $cm^2$ electrode plate disposed thereon so as to form a flat layer having a thickness of 1 mm to 3 mm. Another 20 $cm^2$ electrode plate is placed on the layer to sandwich it between these electrode plates. To eliminate pores in the measurement object, a load of 4 kg is applied to the electrode plate disposed on the layer, and then the thickness (cm) of the layer is measured. The upper and lower electrodes on the layer are connected to an electrometer and a high-voltage power generator. A high voltage is applied between the electrodes such that an electric field of 103.8 V/cm is generated, and a current value (A) flowing between the electrode is read. The temperature during the measurement is 20° C., and the humidity is 50% RH. The volume resistivity (Ω·cm) of the measurement object is computed using the following equation.

$$R=E\times 20/(I-I_0)/L$$

In the above equation, R is the volume resistivity (Ω·cm) of the measurement object, and E is the applied voltage (V). I is the current value (A), and $I_0$ is the current value (A) at an applied value of 0 V. L is the thickness (cm) of the layer. The coefficient 20 represents the area ($cm^2$) of the electrode plates.

[Resin Layer Coating Magnetic Particles]

Examples of the resin forming the resin layer include: styrene-acrylic resin copolymers; polyolefin resins such as polyethylene and polypropylene; polyvinyl and polyvinylidene resins such as polystyrene, acrylic resins, polyacrylonitrile, polyvinyl acetate, polyvinyl alcohol, polyvinyl butyral, polyvinyl chloride, polyvinylcarbazole, polyvinyl ether, and polyvinyl ketone; vinyl chloride-vinyl acetate copolymers; straight silicone resins having organosiloxane bonds and modified products thereof; fluorocarbon resins such as polytetrafluoroethylene, polyvinyl fluoride, polyvinylidene fluoride, and polychlorotrifluoroethylene; polyesters; polyurethanes; polycarbonates; amino resins such as urea-formaldehyde resins; and epoxy resins.

The resin layer may contain inorganic particles for the purpose of controlling charging and resistance. Examples of the inorganic particles include: particles of carbon black; particles of metals such as gold, silver, and copper; particles of metal compounds such as barium sulfate, aluminum borate, potassium titanate, titanium oxide, zinc oxide, tin oxide, antimony-doped tin oxide, tin-dopes indium oxide, and aluminum-doped zinc oxide; and metal-coated resin particles.

To form the resin layer on the surfaces of the magnetic particles, a wet production method or a dry production method, for example, may be used. The wet production method uses a solvent that can dissolve or disperse the resin forming the resin layer. The dry production method does not use the solvent.

Examples of the wet production method include: an immersion method in which the magnetic particles are immersed in a resin solution for forming the resin layer to thereby coat the magnetic particles with the resin; a spray method in which the resin solution for forming the resin layer is sprayed onto the surfaces of the magnetic particles; a fluidized bed method in which the resin solution for forming the resin layer is sprayed onto the magnetic particles floating in a fluidized bed; and a kneader-coater method in which the magnetic particles and the resin solution for forming the resin layer are mixed in a kneader coater and then the solvent is removed.

The resin solution for forming the resin layer used in the wet production method is prepared by dissolving or dispersing the resin and an additional component in the solvent. No particular limitation is imposed on the solvent, so long as it can dissolve or disperse the resin. Examples of the solvent include: aromatic hydrocarbons such as toluene and xylene; ketones such as acetone and methyl ethyl ketone; and ethers such as tetrahydrofuran and dioxane.

Examples of the dry production method include a method in which a dry mixture of the magnetic particles and the resin for forming the resin layer is heated to form the resin layer. Specifically, for example, the magnetic particles and the resin for forming the resin layer are mixed in air and heat-fused to form the resin layer.

The thickness of the resin layer is preferably 0.1 μm to 10 μm and more preferably 0.3 μm to 5 μm.

The ratio of exposed surfaces of the magnetic particles on the surfaces of the resin-coated magnetic particles is preferably 2% to 20%, more preferably 2% to 10%, and still more preferably 3% to 8%.

The ratio of the exposed surfaces of the magnetic particles on the surfaces of the resin-coated magnetic particles is determined by X-ray photoelectron spectroscopy (XPS) as follows.

The resin-coated magnetic particles under study and magnetic particles obtained by removing the resin layer from the resin-coated magnetic particles under study are prepared. For example, to remove the resin layer from the resin-coated magnetic particles, the following methods may be used. The resin component is dissolved using an organic solvent to remove the resin layer. Alternatively, the resin-coated magnetic particles are heated to about 800° C. to eliminate the resin component, and the resin layer is thereby removed. The resin-coated magnetic particles and the magnetic particles with the resin layer removed therefrom are used as measurement samples. For each of the samples, i.e., the resin-coated magnetic particles and the magnetic particles with the resin layer removed, the amount (atomic percent) of Fe is determined by XPS. The ratio of the exposed surfaces of the magnetic particles is computed as (the amount of Fe in the resin-coated magnetic particles)/(the amount of Fe in the magnetic particles)×100.

The ratio of the exposed surfaces of the magnetic particles on the surfaces of the resin-coated magnetic particles can be controlled by changing the amount of the resin used to form the resin layer. The larger the amount of the resin with respect to the amount of the magnetic particles, the smaller the ratio of the exposed portions.

[Characteristics of Carrier]

The volume average particle diameter of the carrier is preferably 15 μm to 510 μm, more preferably 20 μm to 180 μm, and still more preferably 25 μm to 60 μm.

As for the magnetic force of the carrier, its saturation magnetization at a magnetic field of 1,000 oersted is, for example, 40 emu/g or more and preferably 50 emu/g or more. The saturation magnetization is measured in the same manner as in the measurement of the saturation magnetization of the magnetic particles except that the magnetic field applied is increased to a maximum of 1,000 oersted.

The volume resistivity (25° C.) of the carrier is, for example, $1\times10^{7}$ Ω·cm to $1\times10^{15}$ Ω·cm, preferably $1\times10^{8}$ Ω·cm to $1\times10^{14}$ Ω·cm, and more preferably $1\times10^{8}$ Ω·cm to $1\times10^{13}$ Ω·cm. The volume resistivity of the carrier is measured in the same manner as in the measurement of the volume resistivity of the magnetic particles.

[Strontium Titanate Particles]

In the present exemplary embodiment, the average primary particle diameter of the strontium titanate particles may be 10 nm to 100 nm. When the average primary particle diameter of the strontium titanate particles is 10 nm or more, the strontium titanate particles may be prevented from being embedded in the resin layer of the resin-coated magnetic particles and tend to be dispersed uniformly on the surfaces of the resin-coated magnetic particles. When the average primary particle diameter of the strontium titanate particles is 100 nm or less, the strontium titanate particles may be prevented from being separated from the resin-coated magnetic particles, and the electric characteristics of the strontium titanate particles may allow the surface of the carrier to be charged relatively strongly.

From the above point of view, the average primary particle diameter of the strontium titanate particles is preferably 10 nm to 100 nm, more preferably 20 nm to 90 nm, still more preferably 30 nm to 80 nm, and yet more preferably 30 nm to 60 nm.

In the present exemplary embodiment, the primary particle diameters of the strontium titanate particles are the diameters of circles having the same areas as their corresponding primary particle images (so-called equivalent circle diameters), and the average primary particle diameter of the strontium titanate particles is the particle diameter when a cumulative frequency cumulated from a small diameter side in a number-based primary particle diameter distribution is 50%. The primary particle diameters of the strontium titanate particles are determined by analyzing at least 300 strontium titanate particle images.

The average primary particle diameter of the strontium titanate particles can be controlled, for example, by changing various conditions when the strontium titanate particles are produced by a wet production method.

In the present exemplary embodiment, from the viewpoint of reducing the occurrence of fogging, the shape of the strontium titanate particles is not a cubic or cuboidal shape but a rounded shape.

In the present exemplary embodiment, the average circularity of the primary particles forming the strontium titanate particles may be 0.82 to 0.94, and the 84% cumulative circularity of the primary particles may be more than 0.92.

In the present exemplary embodiment, the circularity of a primary particle in the strontium titanate particles is defined as $4\pi\times$(area of primary particle image)/(perimeter of primary particle image)$^2$. The average circularity of the primary particles is the circularity when a cumulative frequency cumulated from a small diameter side in a circularity distribution is 50%, and the 84% cumulative circularity of the primary particles is the circularity when the cumulative frequency cumulated from the small diameter side in the circularity distribution is 84%. The circularity of the strontium titanate particles is determined by analyzing at least 300 strontium titanate particle images.

In the strontium titanate particles, the 84% cumulative circularity of the primary particles is an indicator of their rounded shape. The 84% cumulative circularity of the primary particles will next be described.

FIG. 1A shows an SEM image of a resin particle to which SW-360 manufactured by Titan Kogyo, Ltd., which is an example of strontium titanate particles, has been externally added and also shows a graph of the circularity distribution of the strontium titanate particles determined by analyzing the SEM image. As shown in the SEM image, most of the SW-360 particles have a cubic shape, and cuboidal particles and spherical particles with relatively small diameters are also present. The circularity distribution of the SW-360 particles in this example is concentrated in the range of 0.84 to 0.92. The average circularity is 0.888, and the 84% cumulative circularity is 0.916. This may be because of the following reasons:

(a) Most of the SW-360 particles have a cubic shape.

(b) Projection images of a cube include a regular hexagon (circularity: about 0.907), an elongated hexagon, a square (circularity: about 0.785), and a rectangle that are arranged in a descending order of circularity.

(c) The cubic strontium titanate particles adhere to the resin particle with their corner sticking into the resin particle, so that their projection images are hexagonal.

Judging from the above-described actual circularity distribution of the SW-360 particles and the theoretical projection images of a cube, it can be inferred that, in cubic or cuboidal strontium titanate particles, the 84% cumulative circularity of the primary particles is lower than 0.92.

Figure 1B:
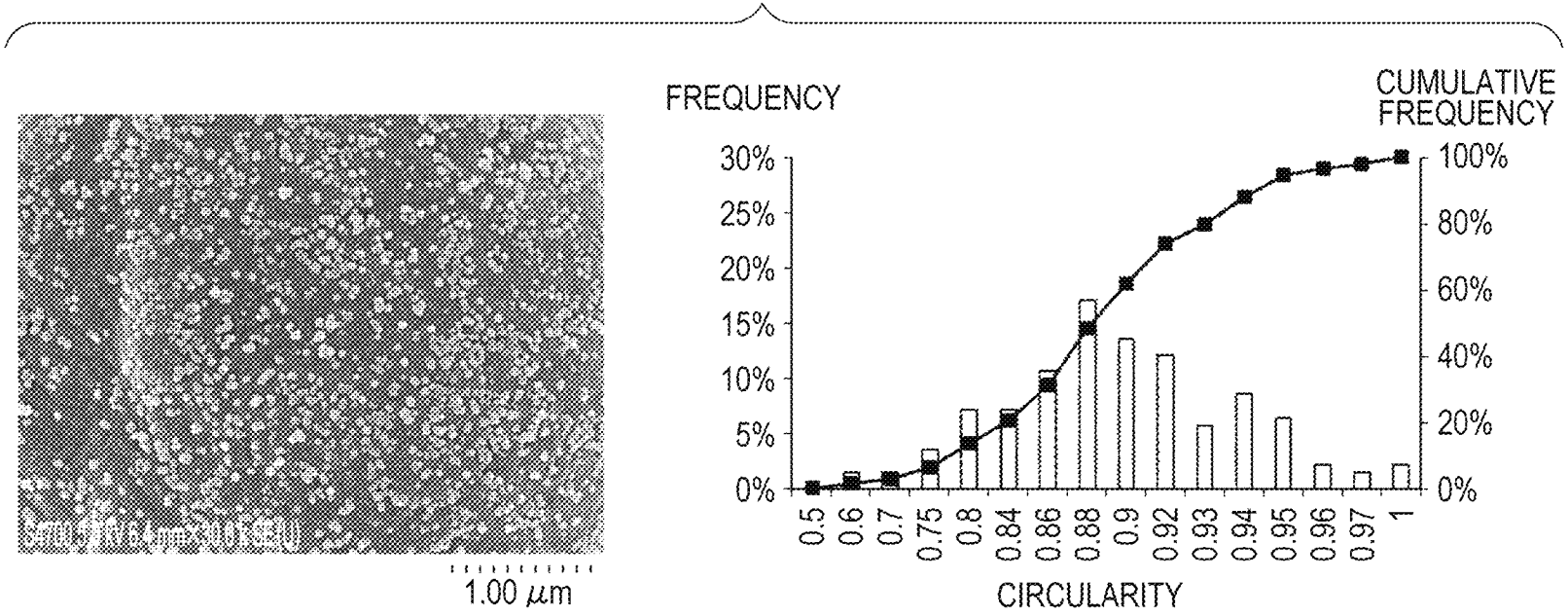
FIG. 1B shows an SEM image of a resin particle to which different strontium titanate particles have been externally added and also shows a graph of the circularity distribution of the strontium titanate particles obtained by analyzing the SEM image.

FIG. 1B shows an SEM image of a resin particle to which different strontium titanate particles have been externally added and also shows a graph of the circularity distribution of the strontium titanate particles determined by analyzing the SEM image. As shown in the SEM image, the strontium titanate particles in this example have a rounded shape. In the strontium titanate particles in this example, the average circularity is 0.883, and the 84% cumulative circularity is 0.935.

As can be seen from the above results, in the strontium titanate particles, the 84% cumulative circularity of the primary particles is an indicator of their rounded shape. When the 84% cumulative circularity is more than 0.92, the primary particles have a rounded shape.

In the present exemplary embodiment, from the viewpoint of preventing the occurrence of fogging, the average circularity of the primary particles forming the strontium titanate particles is preferably 0.82 to 0.94, more preferably 0.84 to 0.94, and still more preferably 0.86 to 0.92.

In the present exemplary embodiment, the standard deviation of the circularity of the primary particles forming the strontium titanate particles is preferably 0.04 to 2.0, more preferably 0.04 to 1.0, and still more preferably 0.04 to 0.50.

Cubic or cuboidal strontium titanate particles tend to have a narrow circularity distribution because of their shape. Therefore, when the standard deviation of the circularity of the primary particles is within the above-described range, the strontium titanate particles do not include a large number of cubes and cuboids.

In the present exemplary embodiment, the half width of a (110) peak of the strontium titanate particles that is obtained by X-ray diffraction is preferably 0.2° to 2.0° and more preferably 0.2° to 1.0°.

The (110) peak of the strontium titanate particles that is obtained by X-ray diffraction is a peak present around a diffraction angle 2θ of 32°. This peak corresponds to a (110) peak of a perovskite crystal.

Strontium titanate particles having a cubic or cuboidal shape have a high degree of perovskite crystallinity, and the half width of the (110) peak is generally less than 0.2°. For example, when the SW-350 manufactured by Titan Kogyo, Ltd. (strontium titanate particles mostly having a cubic shape) is analyzed, the half width of the (110) peak is 0.15°.

Strontium titanate particles having a rounded shape have a lower degree of perovskite crystallinity, and the half width of the (110) peak is large.

In the present exemplary embodiment, the strontium titanate particles may have a rounded shape. The half width of the (110) peak, which is an indicator of the rounded shape, is preferably 0.2° to 2.0°, more preferably 0.2° to 1.0°, and still more preferably 0.2° to 0.5°.

The strontium titanate particles are subjected to X-ray diffraction measurement using an X-ray diffraction apparatus (e.g., product name: RINT Ultima-III manufactured by Rigaku Corporation). The following measurement settings are used: X-ray source: CuKα; voltage: 40 kV; current: 40 mA; sample rotation speed: no rotation; divergence slit: 1.00 mm; vertical divergence limiting slit: 10 mm; scattering slit: open; receiving slit: open; scan mode: FT; counting time: 2.0 seconds; step width: 0.0050°; and operation axis: 10.0000° to 70.0000°. In the present exemplary embodiment of the disclosure, the half width of a peak in an X-ray diffraction pattern is a full width at half maximum.

In the present exemplary embodiment, the strontium titanate particles may be doped with a metal element (hereinafter may be referred to as a dopant) other than titanium and strontium. When the strontium titanate particles contain a dopant, the degree of crystallinity of the perovskite structure decreases, and a rounded shape is obtained.

No particular limitation is imposed on the dopant for the strontium titanate particles, so long as it is a metal element other than titanium and strontium. The dopant may be a metal element that, when ionized, has an ionic radius allowing the metal element to enter the crystal structure of the strontium titanate particles. From this point of view, the dopant for the strontium titanate particles is preferably a metal element that, when ionized, has an ionic radius of 40 pm to 200 pm and more preferably a metal element that, when ionized, has an ionic radius of 60 pm to 150 pm.

Specific examples of the dopant for the strontium titanate particles include lanthanoids, silica, aluminum, magnesium, calcium, barium, phosphorus, sulfur, calcium, vanadium, chromium, manganese, iron, cobalt, nickel, copper, gallium, yttrium, zinc, niobium, molybdenum, ruthenium, rhodium, palladium, silver indium, tin, antimony, barium, tantalum, tungsten, rhenium, osmium, iridium, platinum, and bismuth. Among the lanthanoids, lanthanum or cerium may be selected. From the viewpoint of ease of doping and ease of controlling the shape of the strontium titanate particles, lanthanum may be selected.

From the viewpoint of preventing the strontium titanate particles from being negatively charged excessively, the dopant for the strontium titanate particles is preferably a metal element with an electronegativity of 2.0 or less and more preferably a metal element with an electronegativity of 1.3 or less. In the present exemplary embodiment, the electronegativity is Allred-Rochow electronegativity. Examples of the metal element with an electronegativity of 2.0 or less include lanthanum (electronegativity: 1.08), magnesium (1.23), aluminum (1.47), silica (1.74), calcium (1.04), vanadium (1.45), chromium (1.56), manganese (1.60), iron (1.64), cobalt (1.70), nickel (1.75), copper (1.75), zinc (1.66), gallium (1.82), yttrium (1.11), zirconium (1.22), niobium (1.23), silver (1.42), indium (1.49), tin (1.72), barium (0.97), tantalum (1.33), rhenium (1.46), and cerium (1.06).

From the viewpoint of allowing the strontium titanate particles to have a rounded shape while the perovskite crystal structure is maintained, the amount of the dopant in the strontium titanate particles with respect to the amount of strontium is preferably within the range of 0.1% by mole to 20% by mole, more preferably within the range of 0.1% by mole to 15% by mole, and still more preferably within the range of 0.1% by mole to 10% by mole.

In the present exemplary embodiment, from the viewpoint of improving the effect of the strontium titanate particles, the strontium titanate particles may each have a surface subjected to hydrophobic treatment. It is inferred that the strontium titanate particles subjected to the hydrophobic treatment repel each other on the resin-coated magnetic particles and tend to be dispersed uniformly.

In the present exemplary embodiment, the strontium titanate particles may each have a surface subjected to hydrophobic treatment with a silicon-containing organic compound. The strontium titanate particles subjected to the hydrophobic treatment with the silicon-containing organic compound are less likely to be released to a non-image portion on a photoreceptor than strontium titanate particles subjected to hydrophobic treatment with a treatment agent such as a fatty acid metal salt having a strong tendency to be positively charged, so that image defects are less likely to occur.

The strontium titanate particles each have a surface containing the silicon-containing organic compound in an amount of preferably 1% by mass to 50% by mass with respect to the mass of the particle (more preferably 5% by mass to 40% by mass, still more preferably 5% by mass to 30% by mass, and yet more preferably 10% by mass to 25% by mass).

Specifically, the amount of the silicon-containing organic compound used for the hydrophobic treatment with respect to the mass of the strontium titanate particles is preferably 1% by mass to 50% by mass, more preferably 5% by mass to 40% by mass, still more preferably 5% by mass to 30% by mass, and yet more preferably 10% by mass to 25% by mass.

When the amount of the silicon-containing organic compound used for the hydrophobic treatment is in the above range, the occurrence of fogging may be easily prevented. When the silicon-containing organic compound used for the hydrophobic treatment is 30% by mass or less, the formation of aggregates caused by the hydrophobic-treated surfaces may be prevented.

From the viewpoint of improving the effect of the strontium titanate particles, the mass ratio Si/Sr of silicon (Si) to strontium (Sr) on the surfaces of the strontium titanate particles subjected to the hydrophobic treatment with the silicon-containing organic compound is preferably 0.025 to 0.25 and more preferably 0.05 to 0.20. The mass ratio Si/Sr is computed by X-ray fluorescence qualitative and quantitative analysis.

The X-ray fluorescence analysis on the hydrophobic-treated surfaces of the strontium titanate particles is performed by the following method.

An X-ray fluorescence analyzer (XRF1500 manufactured by Shimadzu Corporation) is used to perform the qualitative and quantitative analysis under the following conditions: X-ray output power: 40 V/70 mA; measurement area: 10 mm in diameter; and measurement time: 15 minutes. Elements analyzed are oxygen (O), silicon (Si), titanium (Ti), strontium (Sr), and other metal elements (Me). Calibration curve data produced separately is used to compute the mass ratio (%) of each element. The mass ratio of silicon (Si) and the mass ratio of strontium (Sr) obtained by the measurement are used to compute the mass ratio Si/Sr.

In the present exemplary embodiment, the common logarithm of the volume specific resistivity R (Ω·cm) of the strontium titanate particles, i.e., log R, is preferably 11 to 14, more preferably 11 to 13, and still more preferably 12 to 13.

The volume specific resistivity R of the strontium titanate particles can be controlled, for example, by changing the type of the dopant, the amount of the dopant, the type of the hydrophobic treatment agent, the amount of the hydrophobic treatment agent, the temperature and time of drying after the hydrophobic treatment, etc.

The volume specific resistivity R of the strontium titanate particles is measured as follows.

A pair of 20-$cm^2$ circular electrode plates (made of steel) connected to an electrometer (KEITHLEY 610C manufactured by KEITHLEY) and a high-voltage power supply (FLUKE 415B manufactured by FLUKE) are used as measurement jigs. The strontium titanate particles are placed on a lower one of the electrode plates so as to form a flat layer with a thickness in the range of 1 mm to 2 mm. Then the strontium titanate particles are subjected to humidity control in an environment with a temperature of 22° C. and a relative humidity of 55% for 24 hours. Next, the upper electrode plate is disposed on the strontium titanate particle layer in an environment with a temperature of 22° C. and a relative humidity of 55%. A weight of 4 kg is placed on the upper electrode plate to eliminate pore in the strontium titanate particle layer, and the thickness of the strontium titanate particle layer in this state is measured. Next, a voltage of 1,000 V is applied between the electrode plates, and a current value is measured. The volume specific resistivity R is computed from the following equation (1):

$$\text{volume specific resistivity } R(\Omega\cdot\text{cm})=V\times S/(A1-A0)/d \quad \text{Equation (1):}$$

In equation (1), V is the applied voltage 1,000 (V); S is the area of the electrode plates (20 $cm^2$); A1 is the current value measured (A); A0 is an initial current value (A) when the applied voltage is 0 V; and d is the thickness (cm) of the strontium titanate particle layer.

In the present exemplary embodiment, the water content of the strontium titanate particles may be 1.5% by mass to 10% by mass. When the water content is 1.5% by mass to 10% by mass (more preferably 2% by mass to 5% by mass), the resistance of the strontium titanate particles is controlled within an appropriate range, and uneven distribution may be prevented because of electrostatic repulsion between the strontium titanate particles. The water content of the strontium titanate particles may be controlled, for example, by producing the strontium titanate particles by a wet production method while the temperature and time of drying treatment are adjusted. When the strontium titanate particles are subjected to hydrophobic treatment, the water content of the strontium titanate particles may be controlled by adjusting the temperature and time of drying treatment performed after the hydrophobic treatment.

The water content of the strontium titanate particles is measured as follows.

20 mg of the measurement sample is placed in a chamber at a temperature of 22° C. and a relative humidity of 55% and left to stand for 17 hours to subject the sample to humidity control. Then, in the interior of a room at a temperature of 22° C. and a relative humidity of 55%, the sample is heated in a nitrogen atmosphere from 30° C. to 250° C. at a temperature increase rate of 30° C./minute using a thermo-balance (Type TGA-50 manufactured by Shimadzu Corporation) to thereby measure the loss on heating (the mass loss on heating). The water content is computed from the measured loss on heating using the following equation.

Water content (% by mass)=(loss on heating from 30° C. to 250° C.)/(mass after humidity control but before heating)×100

The amount of the strontium titanate particles contained in the carrier according to the present exemplary embodiment with respect to the mass of the resin-coated magnetic particles is preferably 0.01% by mass to 0.8% by mass, more preferably 0.01% by mass to 0.5% by mass, still more preferably 0.02% by mass to 0.08% by mass, and yet more preferably 0.04% by mass to 0.05% by mass.

[Method for Producing Strontium Titanate Particles]

The strontium titanate particles may be untreated strontium titanate particles or may be particles prepared by subjecting the surfaces of the strontium titanate particles (may be referred to as base particles) to hydrophobic treatment. No particular limitation is imposed on the method for producing the strontium titanate particles (base particles). From the viewpoint of controlling the diameter and shape of the particles, the production method may be a wet production method.

In the wet production method for the strontium titanate particles, for example, a solution mixture of a titanium oxide source and a strontium source is allowed to react while an aqueous alkali solution is added thereto, and then the product is subjected to acid treatment. In this production method, the diameter of the strontium titanate particles is controlled by changing the mixing ratio of the strontium source to the titanium oxide source, the concentration of the titanium oxide source at the beginning of the reaction, the temperature when the aqueous alkali solution is added, and the addition rate of the aqueous alkali solution, etc.

The titanium oxide source used may be a peptized product prepared by peptizing a hydrolysate of a titanium compound with a mineral acid. Examples of the strontium source include strontium nitrate and strontium chloride.

As for the mixing ratio of the strontium source to the titanium oxide source, the molar ratio $SrO/TiO_2$ is preferably 0.9 to 1.4 and more preferably 1.05 to 1.20. As for the concentration of the titanium oxide source at the beginning of the reaction, the concentration of $TiO_2$ is preferably 0.05 mol/L to 1.3 mol/L and more preferably 0.5 mol/L to 1.0 mol/L.

From the viewpoint of forming the strontium titanate particles into a rounded shape rather than cubic and cuboidal shapes, a dopant source may be added to the solution mixture of the titanium oxide source and the strontium source. Examples of the dopant source include oxides of metals other than titanium and strontium. The metal oxide used as the dopant source is added, for example, in the form of a solution in nitric acid, hydrochloric acid, or sulfuric acid. As for the amount of the dopant source added, the amount of the metal contained in the dopant source with respect to 100 moles of strontium contained in the strontium source is preferably 0.1 moles to 20 moles and more preferably 0.5 moles to 10 moles.

The aqueous alkali solution may be an aqueous sodium hydroxide solution. The higher the temperature of a reaction solution when the aqueous alkali solution is added, the better the crystallinity of the strontium titanate particles obtained. From the viewpoint of obtaining a rounded shape while the perovskite crystal structure is maintained, the temperature of the reaction solution when the aqueous alkali solution is added may be within the range of 60° C. to 100° C. The lower the rate of addition of the aqueous alkali solution, the larger the diameter of the strontium titanate particles obtained. The higher the rate of addition, the smaller the diameter of the strontium titanate particles obtained. The rate of addition of the aqueous alkali solution with respect to the raw materials is, for example, 0.001 equivalents/h to 1.2 equivalents/h and suitably 0.002 equivalents/h to 1.1 equivalents/h.

After the addition of the aqueous alkali solution, acid treatment is performed for the purpose of removing an unreacted portion of the strontium source. The acid treatment is performed using, for example, hydrochloric acid to adjust the pH of the reaction solution to 2.5 to 7.0 and preferably 4.5 to 6.0. After the acid treatment, the reaction solution is subjected to solid-liquid separation, and the solid is dried to thereby obtain the strontium titanate particles.

The strontium titanate particles is subjected to surface treatment, for example, in the following manner. The silicon-containing organic compound serving as a hydrophobic treatment agent and a solvent are mixed to prepare a treatment solution. Then the strontium titanate particles and the treatment solution are mixed under stirring, and then the stirring is continued. After the surface treatment, drying treatment is performed for the purpose of removing the solvent in the treatment solution.

Examples of the silicon-containing organic compound used for the surface treatment of the strontium titanate particles include alkoxysilane compounds, silazane compounds, and silicone oils.

Examples of the alkoxysilane compound used for the surface treatment of the strontium titanate particles include tetramethoxysilane, tetraethoxysilane, methyltrimethoxysilane, ethyltrimethoxysilane, propyltrimethoxysilane, butyltrimethoxysilane, hexyltrimethoxysilane, n-octyltrimethoxysilane, decyltrimethoxysilane, dodecyltrimethoxysilane, vinyltriethoxysilane, methyltriethoxysilane, ethyltriethoxysilane, butyltriethoxysilane, hexyltriethoxysilane, decyltriethoxysilane, dodecyltriethoxysilane, phenyltrimethoxysilane, o-methylphenyltrimethoxysilane, p-methylphenyltrimethoxysilane, phenyltriethoxysilane, benzyltriethoxysilane, dimethyldimethoxysilane, dimethyldiethoxysilane, methylvinyldimethoxysilane, methylvinyldiethoxysilane, diphenyldimethoxysilane, diphenyldiethoxysilane, trimethylmethoxysilane, and trimethylethoxysilane.

Examples of the silazane compound used for the surface treatment of the strontium titanate particles include dimethyldisilazane, trimethyldisilazane, tetramethyldisilazane, pentamethyldisilazane, and hexamethyldisilazane.

Examples of the silicone oil used for the surface treatment of the strontium titanate particles include: silicone oils such as dimethylpolysiloxane, diphenylpolysiloxane, and phenylmethylpolysiloxane; and reactive silicone oils such as amino-modified polysiloxanes, epoxy-modified polysiloxanes, carboxyl-modified polysiloxanes, carbinol-modified polysiloxanes, fluorine-modified polysiloxanes, methacrylic-modified polysiloxanes, mercapto-modified polysiloxanes, and phenol-modified polysiloxanes.

When the silicon-containing organic compound is the alkoxysilane compound or the silazane compound, the solvent used to prepare the treatment solution may be an alcohol (such as methanol, ethanol, propanol, or butanol). When the silicon-containing organic compound is the silicone oil, the solvent may be a hydrocarbon (such as benzene, toluene, n-hexane, or n-heptane).

In the treatment solution, the concentration of the silicon-containing organic compound is preferably 1% by mass to 50% by mass, more preferably 5% by mass to 40% by mass, and still more preferably 10% by mass to 30% by mass.

The amount of the silicon-containing organic compound used for the surface treatment is preferably 1 part by mass to 50 parts by mass, more preferably 5 parts by mass to 40 parts by mass, and still more preferably 5 parts by mass to 30 parts by mass based on 100 parts by mass of the strontium titanate particles.

<Electrostatic Image Developer>

A developer according to an exemplary embodiment contains a toner and the carrier according to the preceding exemplary embodiment.

The developer according to the present exemplary embodiment is prepared by mixing the toner and the carrier according to the preceding exemplary embodiment in an appropriate ratio. The mixing ratio (mass ratio) of the toner and the carrier, i.e., toner:carrier, is preferably 1:100 to 30:100 and more preferably 3:100 to 20:100.

[Toner for Electrostatic Image Development]

No particular limitation is imposed on the toner, and any known toner may be used. Examples of the toner include: a color toner including toner particles containing a binder resin and a coloring agent; and an infrared absorbing toner that uses an infrared absorber instead of a coloring agent. The toner may contain a parting agent, various internal and external additives, etc.

—Binder Resin—

Examples of the binder resin include: vinyl resins composed of homopolymers of monomers such as styrenes (such as styrene, p-chlorostyrene, and α-methylstyrene), (meth) acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene); and vinyl resins composed of copolymers of combinations of two or more of the above monomers.

Other examples of the binder resin include: non-vinyl resins such as epoxy resins, polyester resins, polyurethane resins, polyamide resins, cellulose resins, polyether resins, and modified rosins; mixtures of the non-vinyl resins and the above-described vinyl resins; and graft polymers obtained by polymerizing a vinyl monomer in the presence of any of these resins.

One of these binder resins may be used, or two or more of them may be used in combination.

The binder resin may be a polyester resin. The polyester resin is, for example, any known polyester resin.

The glass transition temperature (Tg) of the polyester resin is preferably 50° C. to 80° C. and more preferably 50° C. to 65° C.

The glass transition temperature is determined by a DSC curve obtained by differential scanning calorimetry (DSC). More specifically, the glass transition temperature is determined from "extrapolated glass transition onset temperature" described in glass transition temperature determination methods in "Testing methods for transition temperatures of plastics" in JIS K7121-1987.

The weight average molecular weight (Mw) of the polyester resin is preferably 5,000 to 1,000,000 and more preferably 7,000 to 500,000. The number average molecular weight (Mn) of the polyester resin may be 2,000 to 100,000. The molecular weight distribution Mw/Mn of the polyester resin is preferably 1.5 to 100 and more preferably 2 to 60.

The weight average molecular weight and the number average molecular weight are measured by gel permeation chromatography (GPC). In the molecular weight distribution measurement by GPC, a GPC measurement apparatus HLC-8120GPC manufactured by TOSOH Corporation is used. A TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The content of the binder resin with respect to the total mass of the toner particles is preferably 40% by mass to 95% by mass, more preferably 50% by mass to 90% by mass, and still more preferably 60% by mass to 85% by mass.

—Coloring Agent—

Examples of the coloring agent include: pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, Phthalocyanine green, and malachite green oxalate; and dyes such as acridine-based dyes, xanthene-based dyes, azo-based dyes, benzoquinone-based dyes, azine-based dyes, anthraquinone-based dyes, thioindigo-based dyes, dioxazine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, and thiazole-based dyes.

One coloring agent may be used, or two or more coloring agents may be used in combination.

The coloring agent used may be optionally subjected to surface treatment or may be used in combination with a dispersant. A plurality of coloring agents may be used in combination.

The content of the coloring agent with respect to the total mass of the toner particles is preferably 1% by mass to 30% by mass and more preferably 3% by mass to 15% by mass.

—Parting Agent—

Examples of the parting agent include: hydrocarbon-based waxes; natural waxes such as carnauba wax, rice wax, and candelilla wax; synthetic and mineral/petroleum-based waxes such as montan wax; and ester-based waxes such as fatty acid esters and montanic acid esters. However, the parting agent is not limited to these waxes.

The melting temperature of the parting agent is preferably 50° C. to 110° C. and more preferably 60° C. to 100° C.

The melting temperature is determined using a DCS curve obtained by differential scanning calorimetry (DSC) from "peak melting temperature" described in melting temperature determination methods in "Testing methods for transition temperatures of plastics" in JIS K7121-1987.

The content of the parting agent with respect to the total mass of the toner particles is preferably 1% by mass to 20% by mass and more preferably 5% by mass to 15% by mass.

—Additional Additives—

Examples of additional additives include well-known additives such as a magnetic material, a charge control agent, and an inorganic powder. These additives are contained in the toner particles as internal additives.

—Characteristics Etc. Of Toner Particles—

The toner particles may have a single layer structure or may have a so-called core-shell structure including a core (core particle) and a coating layer (shell layer) covering the core. Toner particles having the core-shell structure may each include, for example: a core containing a binder resin and optional additives such as a coloring agent and a parting agent; and a coating layer containing a binder resin.

The volume average particle diameter (D50v) of the toner particles is preferably 2 μm to 10 μm and more preferably 4 μm to 8 μm.

The volume average particle diameter (D50v) of the toner particles is measured using Coulter Multisizer II (manufactured by Beckman Coulter, Inc.), and ISOTON-II (manufactured by Beckman Coulter, Inc.) is used as an electrolyte. In the measurement, 0.5 mg to 50 mg of a measurement sample is added to 2 mL of a 5% by mass aqueous solution of a surfactant (which may be sodium alkylbenzenesulfonate) serving as a dispersant. The mixture is added to 100 mL to 150 mL of the electrolyte. The electrolyte with the sample suspended therein is subjected to dispersion treatment for 1 minute using an ultrasonic dispersion apparatus, and then the particle size distribution of particles having diameters within the range of 2 pm to 60 pm is measured using an aperture having an aperture diameter of 100 pm in the Coulter Multisizer II. The number of particles sampled is 50,000.

—External Additives—

Examples of the external additives include inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles used as the external additive may be subjected to hydrophobic treatment. The hydrophobic treatment is performed, for example, by immersing the inorganic particles in a hydrophobic treatment agent. No particular limitation is imposed on the hydrophobic treatment agent. Examples of the hydrophobic treatment agent include silane-based coupling agents, silicone oil, titanate-based coupling agents, and aluminum-based coupling agents. These may be used alone or in combination of two or more.

The amount of the hydrophobic treatment agent is generally, for example, 1 part by mass to 10 parts by mass based on 100 parts by mass of the inorganic particles.

Other examples of the external additives include resin particles (particles of resins such as polystyrene, polymethyl methacrylate, and melamine resin) and a cleaning lubricant (a metal salt of a higher fatty acid, typified by zinc stearate, or particles of a fluorine-based high-molecular weight material).

The amount of the external additives with respect to the mass of the toner particles is preferably 0.01% by mass to 5% by mass and more preferably 0.01% by mass to 2.0% by mass.

—Method for Producing Toner—

The toner is obtained by externally adding the external additives to the toner particles produced. The toner particles may be produced by a dry production method (such as a kneading-grinding method) or by a wet production method (such as an aggregation/coalescence method or a dissolution/suspension method). No particular limitation is imposed on the production method, and any known production method may be used. In particular, the aggregation/coalescence method may be used to obtain the toner particles.

<Image Forming Apparatus and Image Forming Method>

An image forming apparatus and an image forming method in an exemplary embodiment will be described.

The image forming apparatus in the present exemplary embodiment includes: an image holding member; charging means for charging the surface of the image holding member; electrostatic image forming means for forming an electrostatic image on the charged surface of the image holding member; developing means that contains an electrostatic image developer and develops the electrostatic image formed on the surface of the image holding member with the electrostatic image developer to thereby form a toner image; transferring means for transferring the toner image formed on the surface of the image holding member onto a recording medium; and fixing means for fixing the toner image transferred onto the recording medium. The electrostatic image developer used is the electrostatic image developer according to the preceding exemplary embodiment.

In the image forming apparatus in the present exemplary embodiment, an image forming method (an image forming method in the present exemplary embodiment) is performed. The image forming method includes: charging the surface of the image holding member; forming an electrostatic image on the charged surface of the image holding member; developing the electrostatic image formed on the surface of the image holding member with the electrostatic image developer according to the preceding exemplary embodiment to thereby form a toner image; transferring the toner image formed on the surface of the image holding member onto a recording medium; and fixing the toner image transferred onto the surface of the recording medium.

The image forming apparatus in the present exemplary embodiment may be applied to known image forming apparatuses such as: a direct transfer-type apparatus that transfers a toner image formed on the surface of the image holding member directly onto a recording medium; an intermediate transfer-type apparatus that first-transfers a toner image formed on the surface of the image holding member onto the surface of an intermediate transfer body and second-transfers the toner image transferred onto the surface of the intermediate transfer body onto the surface of a recording medium; an apparatus including cleaning means for cleaning the surface of the image holding member after the transfer of the toner image but before charging; and an apparatus including charge eliminating means for eliminating charges on the surface of the image holding member after transfer of the toner image but before charging by irradiating the surface of the image holding member with charge eliminating light.

When the image forming apparatus in the present exemplary embodiment is the intermediate transfer-type apparatus, the transferring means includes, for example: an intermediate transfer body having a surface onto which a toner image is to be transferred; first transferring means for first-transferring a toner image formed on the surface of the image holding member onto the surface of the intermediate transfer body; and second transferring means for second-transferring the toner image transferred onto the surface of the intermediate transfer body onto the surface of a recording medium.

In the image forming apparatus in the present exemplary embodiment, for example, a portion including the developing means may have a cartridge structure (process cartridge) that is detachable from the image forming apparatus. The process cartridge used may be, for example, a process cartridge that contains the electrostatic image developer according to the preceding exemplary embodiment and includes the developing means.

An example of the image forming apparatus in the present exemplary embodiment will be shown, but this is not a limitation. In the following description, major components shown in FIG. 2 will be described, and description of other components will be omitted.

Figure 2:
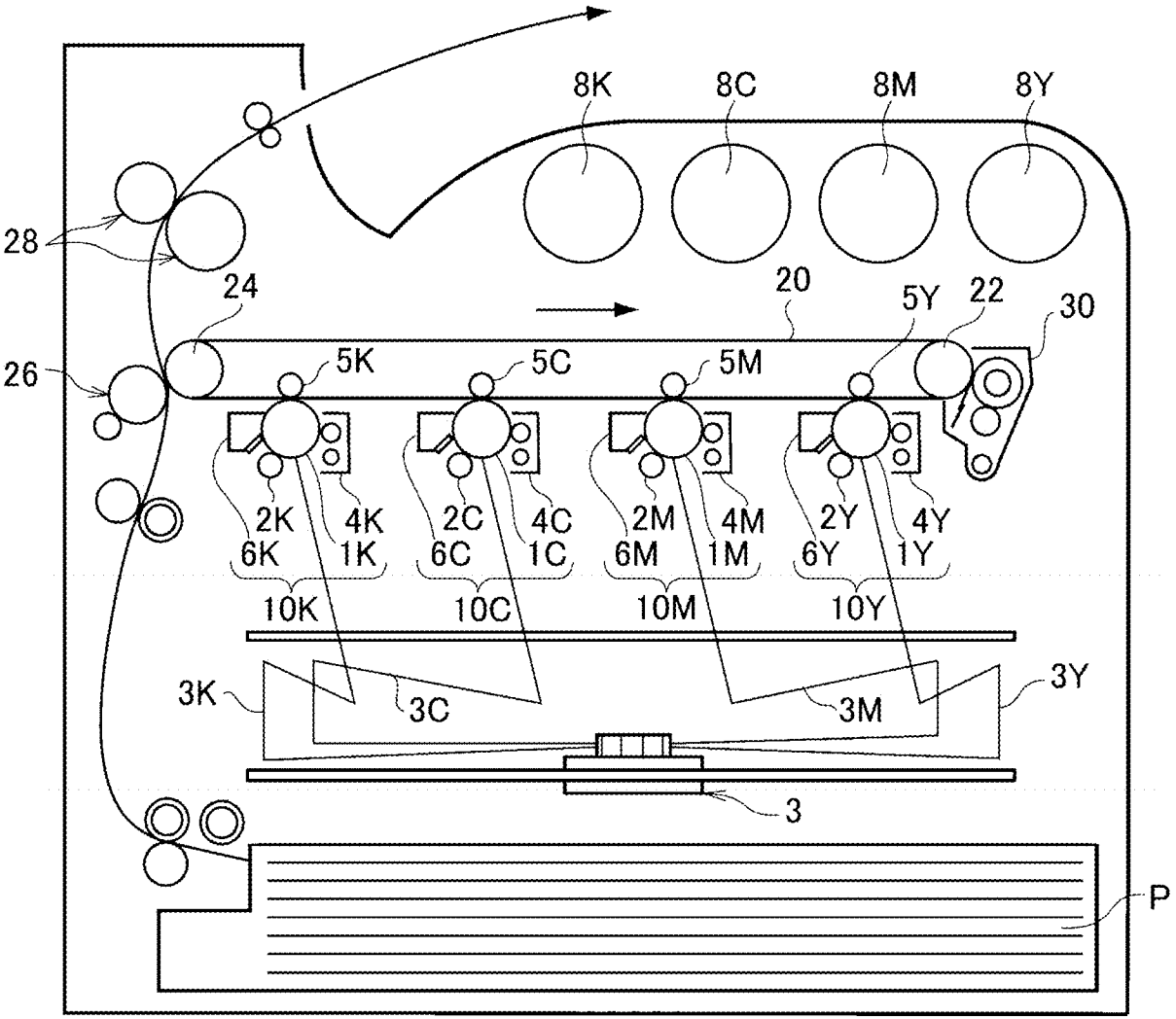
FIG. 2 is a schematic configuration diagram showing an example of an image forming apparatus according to an exemplary embodiment.

FIG. 2 a schematic configuration diagram showing the image forming apparatus in the present exemplary embodiment.

The image forming apparatus shown in FIG. 2 includes first to fourth electrophotographic image forming units 10Y, 10M, 100, and 10K (image forming means) that output yellow (Y), magenta (M), cyan (C), and black (K) images, respectively, based on color-separated image data. These image forming units (hereinafter may be referred to simply as "units") 10Y, 10M, 100, and 10K are arranged so as to be spaced apart from each other horizontally by a prescribed distance. These units 10Y, 10M, 100, and 10K may each be a process cartridge detachable from the image forming apparatus.

An intermediate transfer belt (an example of the intermediate transfer body) 20 is disposed above the units 10Y, 10M, 100, and 10K so as to extend through these units. The intermediate transfer belt 20 is wound around a driving roller 22 and a support roller 24 and runs in a direction from the first unit 10Y toward the fourth unit 10K. A force is applied to the support roller 24 by, for example, an unillustrated spring in a direction away from the driving roller 22, so that a tension is applied to the intermediate transfer belt 20 wound around the rollers. An intermediate transfer body cleaner 30 is disposed on an image holding member-side surface of the intermediate transfer belt 20 so as to be opposed to the driving roller 22.

Yellow, magenta, cyan, and black toners contained in toner cartridges 8Y, 8M, 8C, and 8K, respectively, are supplied to developing devices (examples of the developing means) 4Y, 4M, 4C, and 4K, respectively, of the units 10Y, 10M, 100, and 10K.

The first to fourth units 10Y, 10M, 100, and 10K have the same structure and operate similarly. Therefore, the first unit 10Y that is disposed upstream in the running direction of the intermediate transfer belt and forms a yellow image will be described as a representative unit.

The first unit 10Y includes a photoconductor 1Y serving as an image holding member. A charging roller (an example of the charging means) 2Y, an exposure unit (an example of the electrostatic image forming means) 3, a developing device (an example of the developing means) 4Y, a first transfer roller 5Y (an example of the first transferring means), and a photoconductor cleaner (an example of the cleaning means) 6Y are disposed around the photoconductor 1Y in this order. The charging roller charges the surface of the photoconductor 1Y to a prescribed potential, and the exposure unit 3 exposes the charged surface to a laser beam 3Y according to a color-separated image signal to thereby form an electrostatic image. The developing device 4Y supplies a charged toner to the electrostatic image to develop the electrostatic image, and the first transfer roller 5Y transfers the developed toner image onto the intermediate transfer belt 20. The photoconductor cleaner 6Y removes the toner remaining on the surface of the photoconductor 1Y after the first transfer.

The first transfer roller 5Y is disposed on the inner side of the intermediate transfer belt 20 and placed at a position opposed to the photoconductor 1Y. Bias power sources (not shown) for applying a first transfer bias are connected to the respective first transfer rollers 5Y, 5M, 5C, and 5K of the units. The bias power sources are controlled by an unillustrated controller to change the values of transfer biases applied to the respective first transfer rollers.

A yellow image formation operation in the first unit 10Y will be described.

First, before the operation, the surface of the photoconductor 1Y is charged by the charging roller 2Y to a potential of −600 V to −800 V.

The photoconductor 1Y is formed by stacking a photosensitive layer on a conductive substrate (with a volume resistivity of, for example, $1\times10^{-6}$ Ωcm or less at 20° C.). The photosensitive layer generally has a high resistance (the resistance of a general resin) but has the property that, when irradiated with a laser beam, the specific resistance of a portion irradiated with the laser beam is changed. Therefore, the charged surface of the photoconductor 1Y is irradiated with a laser beam 3Y from the exposure unit 3 according to yellow image data sent from an unillustrated controller. An electrostatic image with a yellow image pattern is thereby formed on the surface of the photoconductor 1Y.

The electrostatic image is an image formed on the surface of the photoconductor 1Y by charging and is a negative latent image formed as follows. The specific resistance of the irradiated portions of the photosensitive layer irradiated with the laser beam 3Y decreases, and this causes charges on the surface of the photoconductor 1Y to flow. However, the charges in portions not irradiated with the laser beam 3Y remain present, and the electrostatic image is thereby formed.

The electrostatic image formed on the photoconductor 1Y rotates to a prescribed developing position as the photoconductor 1Y rotates. Then the electrostatic image on the photoconductor 1Y at the developing position is developed and visualized as a toner image by the developing device 4Y.

An electrostatic image developer containing, for example, at least a yellow toner and a carrier is contained in the developing device 4Y. The yellow toner is agitated in the developing device 4Y and thereby frictionally charged. The charged yellow toner has a charge with the same polarity (negative polarity) as the charge on the photoconductor 1Y and is held on a developer roller (an example of a developer holding member). As the surface of the photoconductor 1Y passes through the developing device 4Y, the yellow toner electrostatically adheres to charge-eliminated latent image portions on the surface of the photoconductor 1Y, and the latent image is thereby developed with the yellow toner. Then the photoconductor 1Y with the yellow toner image formed thereon continues running at a prescribed speed, and the toner image developed on the photoconductor 1Y is transported to a prescribed first transfer position.

When the yellow toner image on the photoconductor 1Y is transported to the first transfer position, a first transfer bias is applied to the first transfer roller 5Y, and an electrostatic force directed from the photoconductor 1Y toward the first transfer roller 5Y acts on the toner image, so that the toner image on the photoconductor 1Y is transferred onto the intermediate transfer belt 20. The transfer bias applied in this case has a (+) polarity opposite to the (−) polarity of the toner and is controlled to, for example, +10 μA in the first unit 10Y by the controller (not shown).

The toner remaining on the photoconductor 1Y is removed and collected by the photoconductor cleaner 6Y.

The first transfer biases applied to first transfer rollers 5M, 5C, and 5K of the second unit 10M and subsequent units are controlled in the same manner as in the first unit.

The intermediate transfer belt 20 with the yellow toner image transferred thereon in the first unit 10Y is sequentially transported through the second to fourth units 10M, 10C and 10K, and toner images of respective colors are superimposed and multi-transferred.

Then the intermediate transfer belt 20 with the four color toner images multi-transferred thereon in the first to fourth units reaches a secondary transfer portion that is composed of the intermediate transfer belt 20, the support roller 24 in contact with the inner surface of the intermediate transfer belt, and a secondary transfer roller (an example of the second transferring means) 26 disposed on the image holding surface side of the intermediate transfer belt 20. A recording paper sheet (an example of the recording medium) P is supplied to a gap between the secondary transfer roller 26 and the intermediate transfer belt 20 in contact with each other at a prescribed timing through a supply mechanism, and a secondary transfer bias is applied to the support roller 24. The transfer bias applied in this case has the same polarity (−) as the polarity (−) of the toner, and an electrostatic force directed from the intermediate transfer belt 20 toward the recording paper sheet P acts on the toner image, so that the toner image on the intermediate transfer belt 20 is transferred onto the recording paper sheet P. In this case, the secondary transfer bias is determined according to a resistance detected by resistance detection means (not shown) for detecting the resistance of the secondary transfer portion and is voltage-controlled.

Then the recording paper sheet P is transported to a press contact portion (nip portion) of a pair of fixing rollers in a fixing device (an example of the fixing means) 28, and the toner image is fixed onto the recording paper sheet P to thereby form a fixed image.

Examples of the recording paper sheet P onto which a toner image is to be transferred include plain paper sheets used for electrophotographic copying machines, printers, etc. Examples of the recording medium include, in addition to the recording paper sheets P, transparencies.

To further improve the smoothness of the surface of a fixed image, it may be necessary that the surface of the recording paper sheet P be smooth. For example, coated paper prepared by coating the surface of plain paper with, for example, a resin, art paper for printing, etc. are suitably used.

The recording paper sheet P with the color image fixed thereon is transported to an ejection portion, and a series of the color image formation operations is thereby completed.

<Process Cartridge>

A process cartridge in an exemplary embodiment will be described.

The process cartridge in the present exemplary embodiment includes developing means that contains the electrostatic image developer according to the preceding exemplary embodiment and develops an electrostatic image formed on the surface of an image holding member with the electrostatic image developer to thereby form a toner image. The process cartridge is detachable from the image forming apparatus.

The structure of the process cartridge in the present exemplary embodiment is not limited to the above described structure. The process cartridge may include, in addition to the developing means, at least one optional unit selected from other means such as an image holding member, charging means, electrostatic image forming means, and transferring means.

An example of the process cartridge in the present exemplary embodiment will be shown, but this is not a limitation. In the following description, major components shown in FIG. 3 will be described, and description of other components will be omitted.

Figure 3:
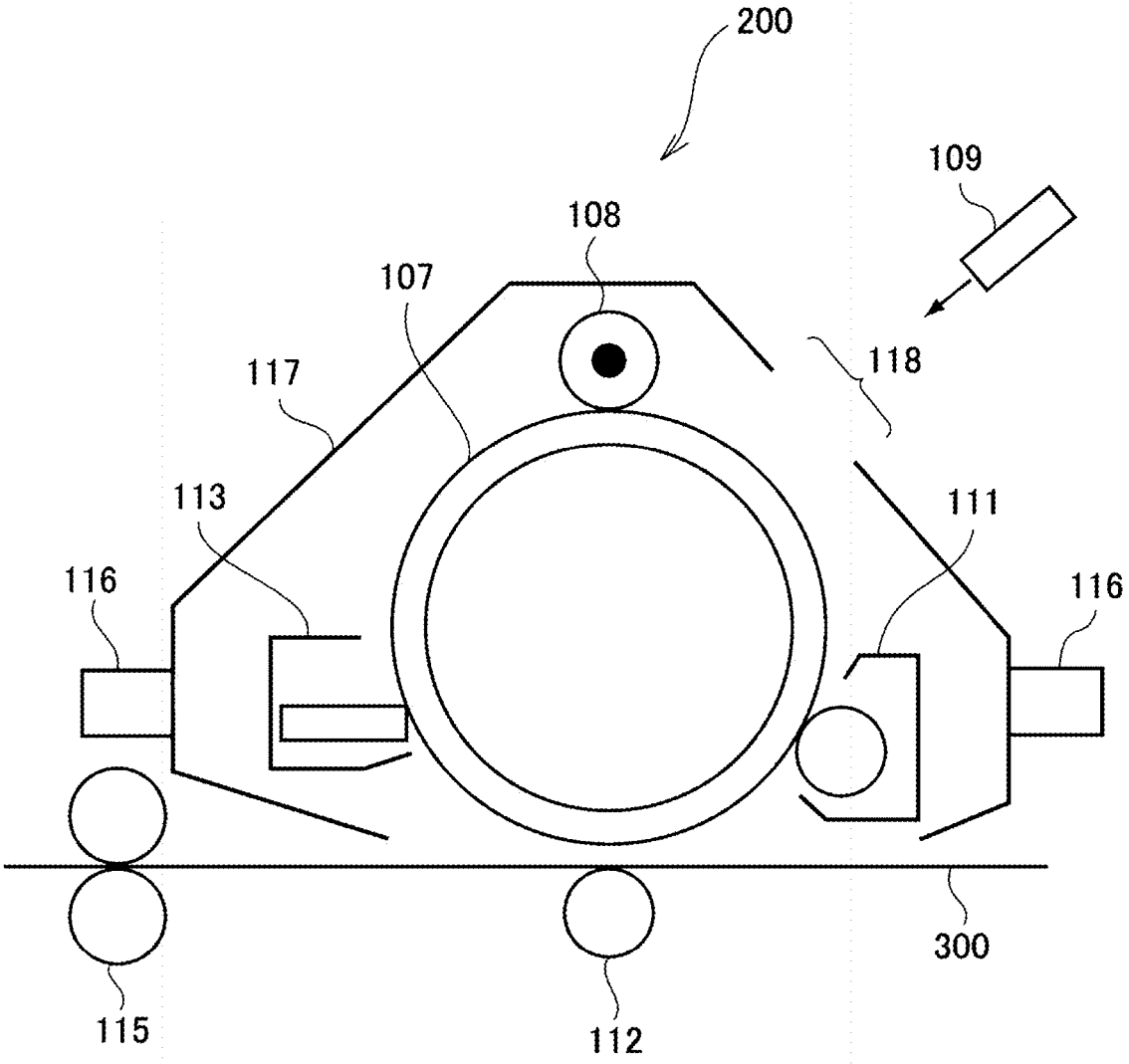
FIG. 3 is a schematic configuration diagram showing an example of a process cartridge detachably attached to the image forming apparatus according to an exemplary embodiment.

FIG. 3 is a schematic configuration diagram showing the process cartridge in the present exemplary embodiment.

The process cartridge 200 shown in FIG. 3 includes, for example, a housing 117 including mounting rails 116 and an opening 118 for light exposure and further includes: a photoconductor 107 (an example of the image holding member); a charging roller 108 (an example of the charging means) disposed on the circumferential surface of the photoconductor 107; a developing device 111 (an example of the developing means); and a photoconductor cleaner 113 (an example of the cleaning means), which are integrally combined and held in the housing 117 to thereby form a cartridge.

In FIG. 3, 109 denotes an exposure unit (an example of the electrostatic image forming means), and 112 denotes a transferring device (an example of the transferring means. 115 denotes a fixing device (an example of the fixing means), and 300 denotes a recording paper sheet (an example of the recording medium).

EXAMPLES

The exemplary embodiments of the disclosure will be described in detail by way of Examples. However, the exemplary embodiments of the disclosure are not limited to these Examples. In the following description, "parts" and "%" are based on mass, unless otherwise specified.

<Production of Toner>

[Preparation of Resin Particle Dispersion (1)]

Ethylene glycol (Wako Pure Chemical Industries, Ltd.) 37 parts

Neopentyl glycol (Wako Pure Chemical Industries, Ltd.) 65 parts 1,9-Nonanediol (Wako Pure Chemical Industries, Ltd.) 32 parts Terephthalic acid (Wako Pure Chemical Industries, Ltd.) 96 parts The above materials are placed in a flask and heated to a temperature of 200° C. over 1 hour. After confirmation that the reaction system has been uniformly stirred, 1.2 parts of dibutyl tin oxide is added. While water produced is removed by evaporation, the temperature is increased to 240° C. over 6 hours, and the stirring is continued at 240° C. for 4 hours to thereby obtain a polyester resin (acid value: 9.4 mgKOH/g, weight average molecular weight: 13,000, glass transition temperature: 62° C.). This polyester resin in a molten state is transferred to an emulsifying-dispersing apparatus (CAVITRON CD1010, EUROTEC Co., Ltd.) at a rate of 100 g/minute. Separately, diluted ammonia water prepared by diluting reagent ammonia water with ion exchanged water to a concentration of 0.37% is placed in a tank. While heated to 120° C. using a heat exchanger, the diluted ammonia water, together with the polyester resin, is transferred to the emulsifying-dispersing apparatus at a rate of 0.1 L/minute. The emulsifying-dispersing apparatus is operated under the following conditions: rotor rotation speed: 60 Hz; and pressure: 5 kg/cm$^2$. A resin particle dispersion (1) with a volume average particle diameter of 160 nm and a solid content of 30% is thereby obtained.

[Preparation of Resin Particle Dispersion (2)]

Decanedioic acid (TOKYO CHEMICAL INDUSTRY Co., Ltd.) 81 parts

Hexanediol (Wako Pure Chemical Industries, Ltd.) 47 parts

The above materials are placed in a flask and heated to a temperature of 160° C. over 1 hour. After confirmation that the reaction system has been uniformly stirred, 0.03 parts of dibutyl tin oxide is added. While water produced is removed by evaporation, the temperature is increased to 200° C. over 6 hours, and the stirring is continued at 200° C. for 4 hours. Then the reaction solution is cooled and subjected to solid-liquid separation. The solid is dried at a temperature of 40° C. under reduced pressure to thereby obtain a polyester resin (C1) (melting point: 64° C., weight average molecular weight: 15,000).

Polyester resin (C1) 50 parts

Anionic surfactant (Neogen SC, DAI-ICHI KOGYO SEIYAKU Co., Ltd.) 2 parts

Ion exchanged water 200 parts

The above materials are heated to 120° C., sufficiently dispersed using a homogenizer (ULTRA-TURRAX T50, IKA), and then subjected to dispersion treatment using a pressure discharge-type homogenizer. When the volume average particle diameter reaches 180 nm, the product is collected, and a resin particle dispersion (2) with a solid content of 20% is thereby obtained.

[Preparation of Coloring Agent Particle Dispersion (1)]

Cyan pigment (Pigment Blue 15:3, Dainichiseika Color & Chemicals Mfg. Co., Ltd.) 10 parts Anionic surfactant (Neogen SC, DAI-ICHI KOGYO SEIYAKU Co., Ltd.) 2 parts Ion exchanged water 80 parts The above materials are mixed and dispersed for 1 hour using a high-pressure impact disperser (Ultimaizer HJP30006, Sugino Machine Limited) to thereby obtain a coloring agent particle dispersion (1) with a volume average particle diameter of 180 nm and a solid content of 20%.

[Preparation of Parting Agent Particle Dispersion (1)]

Paraffin wax (HNP-9, Nippon Seiro Co., Ltd.) 50 parts

Anionic surfactant (Neogen SC, DAI-ICHI KOGYO SEIYAKU Co., Ltd.) 2 parts

Ion exchanged water 200 parts

The above materials are heated to 120° C., sufficiently dispersed using a homogenizer (ULTRA-TURRAX T50, IKA), and then subjected to dispersion treatment using a pressure discharge-type homogenizer. When the volume average particle diameter reaches 200 nm, the product is collected, and a parting agent particle dispersion (1) with a solid content of 20% is thereby obtained.

[Production of Toner (1)]

Resin particle dispersion (1) 150 parts

Resin particle dispersion (2) 50 parts

Coloring agent particle dispersion (1) 25 parts

Parting agent particle dispersion (1) 35 parts

Aluminum polychloride 0.4 parts

Ion exchanged water 100 parts

The above materials are placed in a stainless steel-made round flask, mixed and dispersed sufficiently using a homogenizer (ULTRA-TURRAXT50, IKA), and then heated to 48° C. in an oil bath for heating while the mixture in the flask is stirred. The reaction system is held at 48° C. for 60 minutes, and then an additional 70 parts of the resin particle dispersion (1) is gently added. Next, a 0.5 mol/L aqueous sodium hydroxide solution is used to adjust the pH to 8.0. The flask is hermetically sealed, and a stirring shaft is magnetically sealed. While the stirring is continued, the reaction system is heated to 90° C. and held for 30 minutes. Next, the reaction system is cooled at a cooling rate of 5° C./minute, subjected to solid-liquid separation, and washed sufficiently with ion exchanged water. Then the mixture is subjected to solid-liquid separation, re-dispersed in ion exchanged water at 30° C., and washed by stirring at a rotation speed of 300 rpm for 15 minutes. This washing procedure is repeated 6 times. When the pH of the filtrate reaches 7.54 and its electric conductivity reaches 6.5 μS/cm, the mixture is subjected to solid-liquid separation, and vacuum drying is performed for 24 hours to thereby obtain toner particles with a volume average particle diameter of 5.7 μm.

100 Parts of the above toner particles and 2.5 parts of silica particles (subjected to hydrophobic surface treatment with hexamethyldisilazane, average primary particle diameter: 40 nm) are mixed using a Henschel mixer to thereby obtain a toner (1).

<Production of Magnetic Particles>

[Ferrite Particles (1)]

1,597 Parts of $Fe_2O_3$, 712 parts of $Mn(OH)_2$, 116 parts of $Mg(OH)_2$, 20 parts of $SrCO_3$, and 30 parts of $CaCO_3$ are mixed. Then a dispersant, water, and zirconia beads with a diameter of 1 mm are added to the mixture, and the resulting mixture is pulverized and mixed using a sand mill. The zirconia beads are removed by filtration. Then the filtrate is dried and calcinated using a rotary kiln for 2 hours under the following conditions: rotation speed: 20 rpm; and temperature: 970° C. A dispersant and water are added to the calcinated product obtained, and 8 parts of polyvinyl alcohol is further added. The mixture is pulverized and mixed using a wet ball mill for 5 hours. The volume average particle diameter of the pulverized product obtained is 1.2 μm. Next, a spray dryer is used to granulate the pulverized product into particles with a diameter of 40 μm. The granulated product is fired using an electric furnace in an oxygen-nitrogen mixed atmosphere with an oxygen concentration of 1 vol. % at 1,400° C. for 4 hours. The fired product obtained is pulverized and classified to thereby obtain ferrite particles (1). The volume average particle diameter of the ferrite particles (1) is 35 μm.

[Ferrite Particles (2) to (17)]

Ferrite particles (2) to (17) are produced in the same manner as in the production of the ferrite particles (1) except that the amount of $SrCO_3$ and the amount of $CaCO_3$ are changed as shown in Table 1.

The ferrite particles (1) to (17) are used as samples. For each of the samples, the content of the calcium element and the content of the strontium element are analyzed by the method described above.

<Production of Resin-Coated Magnetic Particles>

Cyclohexyl acrylate resin (weight average molecular weight: 50,000) 30 parts

Polyisocyanate (CORONATE L, TOSOH Corporation) parts

Carbon black (VXC72, Cabot Corporation) 4 parts

Toluene 250 parts

Methanol 50 parts

The above materials and glass beads (diameter: 1 mm, the same amount as toluene) are placed in a sand mill (Kansai Paint Co., Ltd.), and the mixture is stirred at a rotation speed of 1,200 rpm for 30 minutes to thereby obtain a coating solution (1) with a solid content of 11%.

200 Parts of one type of the ferrite particles (1) to (17) are placed in a vacuum degassed-type kneader. Then 36 parts of the coating solution (1) is added to the kneader. While the pressure in the kneader is reduced, the mixture is heated under stirring and dried in an atmosphere at 90° C. and −720 mHg under stirring for 30 minutes. Next, the product is sieved with a sieve with a mesh size of 75 μm. Resin-coated ferrite particles (1) to (17) are obtained in the manner described above.

The resin-coated ferrite particles (1) to (17) are used as samples. For each of the samples, the ratio of exposed ferrite particles is analyzed by the method described above.

The compositions etc. of the resin-coated ferrite particles (1) to (17) are shown in Table 1. In Table 1, "D50v" means the volume average particle diameter.

TABLE 1

| Resin-coated ferrite particles | Ferrite particles | Materials of ferrite particles | | | | | Amounts of elements in ferrite particles | | | Ferrite particles D50v μm | Resin-coated ferrite particles: Ratio of exposed surfaces of ferrite particles % | Resin-coated ferrite particles: D50v μm |
|---|---|---|---|---|---|---|---|---|---|---|---|---|
| | | $Fe_2O_3$ Parts by mass | $Mn(OH)_2$ Parts by mass | $Mg(OH)_2$ Parts by mass | $SrCO_3$ Parts by mass | $CaCO_3$ Parts by mass | Sr % by mass | Ca % by mass | Total % by mass | | | |
| (1) | (1) | 1597 | 712 | 116 | 20 | 30 | 0.5 | 0.5 | 1.0 | 35 | 3 | 36 |
| (2) | (2) | 1597 | 712 | 116 | 0 | 57 | 0 | 1.0 | 1.0 | 35 | 3 | 36 |
| (3) | (3) | 1597 | 712 | 116 | 38.7 | 0 | 1.0 | 0 | 1.0 | 35 | 3 | 36 |
| (4) | (4) | 1597 | 712 | 116 | 0 | 5.7 | 0 | 0.1 | 0.1 | 35 | 3 | 36 |
| (5) | (5) | 1597 | 712 | 116 | 3.8 | 0 | 0.1 | 0 | 0.1 | 35 | 3 | 36 |
| (6) | (6) | 1597 | 712 | 116 | 0 | 11.4 | 0 | 0.2 | 0.2 | 35 | 3 | 36 |
| (7) | (7) | 1597 | 712 | 116 | 7.6 | 0 | 0.2 | 0 | 0.2 | 35 | 3 | 36 |
| (8) | (8) | 1597 | 712 | 116 | 0 | 33.7 | 0 | 0.6 | 0.6 | 35 | 3 | 36 |
| (9) | (9) | 1597 | 712 | 116 | 0 | 85.3 | 0 | 1.5 | 1.5 | 35 | 3 | 36 |
| (10) | (10) | 1597 | 712 | 116 | 40 | 60 | 1.0 | 1.0 | 2.0 | 35 | 3 | 36 |
| (11) | (11) | 1597 | 712 | 116 | 0 | 114 | 0 | 2.0 | 2.0 | 35 | 3 | 36 |
| (12) | (12) | 1597 | 712 | 116 | 77.5 | 0 | 2.0 | 0 | 2.0 | 35 | 3 | 36 |
| (13) | (13) | 1597 | 712 | 116 | 0 | 142 | 0 | 2.5 | 2.5 | 35 | 3 | 36 |
| (14) | (14) | 1597 | 712 | 116 | 97 | 0 | 2.5 | 0 | 2.5 | 35 | 3 | 36 |
| (15) | (15) | 1597 | 712 | 116 | 46 | 68.2 | 1.2 | 1.2 | 2.4 | 35 | 3 | 36 |
| (16) | (16) | 1597 | 712 | 116 | 0 | 3 | 0 | 0.05 | 0.05 | 35 | 3 | 36 |
| (17) | (17) | 1597 | 712 | 116 | 1.9 | 0 | 0.05 | 0 | 0.05 | 35 | 3 | 36 |

<Production of Strontium Titanate Particles>

[Strontium Titanate Particles (1)]

Metatitanic acid serving as a desulfurized and peptized titanium source is collected in an amount of 0.7 moles in terms of $TiO_2$ and placed in a reaction vessel. Next, an aqueous strontium chloride solution is added in an amount of 0.77 moles to the reaction vessel such that the molar ratio $SrO/TiO_2$ is 1.1. Then a solution prepared by dissolving lanthanum oxide in nitric acid is added to the reaction vessel such that the amount of lanthanum with respect to 100 moles of strontium is 2.5 moles. The initial $TiO_2$ concentration in the mixture of these three materials is adjected to 0.75 mol/L. Then the solution mixture is stirred and heated to 90° C. While the temperature of the solution is maintained at 90° C., 153 mL of a 10N aqueous sodium hydroxide solution is added over 4 hours under stirring. Then, while the temperature of the solution is maintained at 90° C., the stirring is continued for 1 hour. Next, the reaction solution is cooled to 40° C. Then hydrochloric acid is added until the pH of the solution reaches 5.5, and the resulting mixture is stirred for 1 hour. Then decantation and re-dispersion in water are repeated to wash the precipitate. Hydrochloric acid is added to the slurry containing the washed precipitate to adjust the pH to 6.5, and the solid is separated by filtration and dried. An ethanol solution of i-butyltrimethoxysilane (i-BTMS) is added to the dried solid such that the amount of i-BTMS with respect to 100 parts of the solid is 20 parts, and the mixture is stirred for 1 hour. The solid is separated by filtration and dried in air at 130° C. for 7 hours to thereby obtain strontium titanate particles (1).

[Strontium Titanate Particles (2)]

Strontium titanate particles (2) are produced in the same manner as in the production of the strontium titanate particles (1) except that the time spent for the dropwise addition of the 10N aqueous sodium hydroxide solution is changed to 1 hour.

[Strontium Titanate Particles (3)]

Strontium titanate particles (3) are produced in the same manner as in the production of the strontium titanate particles (1) except that the time spent for the dropwise addition of the 10N aqueous sodium hydroxide solution is changed to 2.8 hours.

[Strontium Titanate Particles (4)]

Strontium titanate particles (4) are produced in the same manner as in the production of the strontium titanate particles (1) except that the time spent for the dropwise addition of the 10N aqueous sodium hydroxide solution is changed to 11 hours.

[Strontium Titanate Particles (5)]

Strontium titanate particles (5) are produced in the same manner as in the production of the strontium titanate particles (1) except that the time spent for the dropwise addition of the 10N aqueous sodium hydroxide solution is changed to 14.5 hours.

[Strontium Titanate Particles (6)]

Strontium titanate particles (6) are produced in the same manner as in the production of the strontium titanate particles (1) except that the time spent for the dropwise addition of the 10N aqueous sodium hydroxide solution is changed to 17 hours.

[Strontium Titanate Particles (7)]

Commercial strontium titanate particles (SW-360 manufactured by Titan Kogyo, Ltd.) are prepared and subjected to the same i-BTMS surface treatment as in the production of the strontium titanate particles (1) to thereby produce strontium titanate particles (7). The SW-360 manufactured by Titan Kogyo, Ltd. is strontium titanate particles that are not doped with a metal element, and their surface is untreated.

[Measurement of Shape of Strontium Titanate Particles]

Resin particles prepared separately and one type of the strontium titanate particles (1) to (7) are mixed using a Henschel mixer at a mixing peripheral speed of 30 m/second for 15 minutes. The mixture is sieved using a vibrating sieve with a mesh size of 45 μm to cause the strontium titanate particles to adhere to the resin particles.

An image of the resin particles with the strontium titanate particles adhering thereto is taken at a magnification of 40,000× using a scanning electron microscope (SEM) (S-4700 manufactured by Hitachi High-Technologies Corporation). Image information about arbitrarily selected 300 strontium titanate particles is analyzed through an interface using image processing software WinRoof (MITANI CORPORATION). The equivalent circle diameter, area, and circumference of each of the primary particle images are determined, and the circularity=$4\pi\times(\text{area})/(\text{circumference})^2$ is also determined. An equivalent circle diameter when a cumulative frequency cumulated from a small diameter side in an equivalent circle diameter distribution is 50% is used as the average primary particle diameter. A circularity when a cumulative frequency cumulated from a small side in a circularity distribution is 50% is used as the average circularity, and a circularity when the cumulative frequency cumulated from the small side in the circularity distribution is 84% is used as the 84% cumulative circularity.

[X-Ray Diffraction of Strontium Titanate Particles]

The strontium titanate particles (1) to (7) are used as samples. For each of the samples, crystal structure analysis is performed using an X-ray diffraction apparatus (product name: RINT Ultima-III manufactured by Rigaku Corporation) under the conditions described above. The strontium titanate particles (1) to (7) have a peak corresponding to a (110) peak of the perovskite structure at around a diffraction angle $2\theta=32°$.

[Volume specific resistivity R of strontium titanate particles]

The strontium titanate particles (1) to (7) are used as samples. For each of the samples, its volume specific resistivity R is measured by the measurement method described above.

[Water Content of Strontium Titanate Particles]

The strontium titanate particles (1) to (7) are used as samples. For each of the samples, its water content is measured by the measurement method described above.

The characteristics of the strontium titanate particles (1) to (7) are shown in Table 2.

TABLE 2

| Strontium titanate particles | Dopant | Surface treatment agent | Average primary particle diameter [nm] | Average circularity | 84% cumulative circularity | Half width of (110) peak [°] |
|---|---|---|---|---|---|---|
| (1) | La | i-BTMS | 53 | 0.925 | 0.952 | 0.32 |
| (2) | La | i-BTMS | 25 | 0.938 | 0.973 | 0.82 |
| (3) | La | i-BTMS | 38 | 0.931 | 0.958 | 0.43 |
| (4) | La | i-BTMS | 81 | 0.903 | 0.932 | 0.31 |
| (5) | La | i-BTMS | 94 | 0.856 | 0.924 | 0.24 |
| (6) | La | i-BTMS | 108 | 0.824 | 0.922 | 0.21 |
| (7) | — | i-BTMS | 80 | 0.888 | 0.916 | 0.15 |

<Production of Carriers and Developers>

Example 1

100 Parts of the resin-coated ferrite particles (1) and 0.05 parts of the strontium titanate particles (1) are placed in a V blender and stirred and mixed for 20 minutes to thereby obtain a carrier (1).

100 Parts of the carrier (1) and 6 parts of the toner (1) are placed in a V blender and stirred for 20 minutes. Then the mixture is sieved with a sieve having a mesh size of 212 μm to thereby obtain a cyan developer.

Examples 2 to 80 and Comparative Examples 1 to 12

Carriers and developers are produced in the same manner as in Example 1 except that the type of the resin-coated ferrite particles and the type of the strontium titanate particles or their amount used for external addition (% by mass with respect to the mass of the resin-coated ferrite particles) are changed as shown in Tables 3 and 4.

<Performance Evaluation>

One of the developers is placed in an image forming apparatus (an apparatus prepared by modifying DocuCentre Color 400) and left to stand at a temperature of 30° C. and a relative humidity of 88% for 12 hours. After this, images are continuously formed on 1,000 A4 size paper sheets. The images are formed as follows. A 100% density image with a size of 20 cm×25 cm is formed on a longitudinally upper portion of each paper sheet, and alphabetical letters from A to Z are formed below the image in MS Gothic 14-point half-size font. The appearance of the letters on the 1,000th paper sheet is visually checked and judged as follows.

—Fogging—

A: No toner fogging is found around the letters.

B: Slight toner fogging is found around the letters (the fogging is noticeable when a 5× magnifying glass is used), but the toner fogging does not cause any problem.

C: Slight toner fogging is visually noticeable around the letters, but the degree of the toner fogging is slight and practically acceptable.

D: Toner fogging is visually noticeable around the letters, but the degree of the toner fogging is slight and practically acceptable.

E: Toner fogging is found around the letters, and the degree of the fogging is practically unacceptable.

—Reproducibility of Fine Lines—

A: No thickening, blurring, and smearing of lines are found.

B: Slight thickening, blurring, and smearing of lines are found but do not cause any problem.

C: Thickening, blurring, and smearing of lines are found, but their degree is slight and practically acceptable.

D: Thickening, blurring, and smearing of lines are found, and their degree is practically unacceptable.

The compositions and the results of the performance evaluation in Examples 1 to 80 and Comparative Examples 1 to 12 are shown in Tables 3 and 4.

TABLE 3

| | Resin-coated ferrite particles | | | | Strontium titanate particles | | | | | | | | Image evaluation | |
|---|---|---|---|---|---|---|---|---|---|---|---|---|---|---|
| | Ferrite particles | | | | | | | | | | | | | |
| | Type — | Sr % by mass | Ca % by mass | Total % by mass | Type — | Dopant — | Surface treatment agent — | Average primary particle diameter nm | Average circularity — | 84% cumulative circularity — | Half width of (110) peak ° | Amount added externally % by mass | Fog-ging | Fine line repro-ducibility |
| Example 1 | (1) | 0.5 | 0.5 | 1.0 | (1) | La | i-BTMS | 53 | 0.925 | 0.952 | 0.32 | 0.05 | A | A |
| Example 2 | (1) | 0.5 | 0.5 | 1.0 | (1) | La | i-BTMS | 53 | 0.925 | 0.952 | 0.32 | 0.008 | B | A |
| Example 3 | (1) | 0.5 | 0.5 | 1.0 | (1) | La | i-BTMS | 53 | 0.925 | 0.952 | 0.32 | 0.45 | B | A |
| Example 4 | (1) | 0.5 | 0.5 | 1.0 | (1) | La | i-BTMS | 53 | 0.925 | 0.952 | 0.32 | 0.60 | B | A |
| Example 5 | (1) | 0.5 | 0.5 | 1.0 | (2) | La | i-BTMS | 25 | 0.938 | 0.973 | 0.82 | 0.05 | B | A |
| Example 6 | (1) | 0.5 | 0.5 | 1.0 | (3) | La | i-BTMS | 38 | 0.931 | 0.958 | 0.43 | 0.05 | A | A |
| Example 7 | (1) | 0.5 | 0.5 | 1.0 | (4) | La | i-BTMS | 81 | 0.903 | 0.932 | 0.31 | 0.05 | B | A |
| Example 8 | (1) | 0.5 | 0.5 | 1.0 | (5) | La | i-BTMS | 94 | 0.856 | 0.924 | 0.24 | 0.05 | C | A |
| Example 9 | (1) | 0.5 | 0.5 | 1.0 | (6) | La | i-BTMS | 108 | 0.824 | 0.922 | 0.21 | 0.05 | D | A |
| Comparative Example 1 | (1) | 0.5 | 0.5 | 1.0 | (7) | — | i-BTMS | 80 | 0.888 | 0.916 | 0.15 | 0.05 | E | A |
| Example 10 | (2) | 0 | 1.0 | 1.0 | (1) | La | i-BTMS | 53 | 0.925 | 0.952 | 0.32 | 0.05 | A | B |
| Example 11 | (2) | 0 | 1.0 | 1.0 | (2) | La | i-BTMS | 25 | 0.938 | 0.973 | 0.82 | 0.05 | B | B |
| Example 12 | (2) | 0 | 1.0 | 1.0 | (3) | La | i-BTMS | 38 | 0.931 | 0.958 | 0.43 | 0.05 | A | B |
| Example 13 | (2) | 0 | 1.0 | 1.0 | (4) | La | i-BTMS | 81 | 0.903 | 0.932 | 0.31 | 0.05 | B | B |
| Example 14 | (2) | 0 | 1.0 | 1.0 | (5) | La | i-BTMS | 94 | 0.856 | 0.924 | 0.24 | 0.05 | C | B |
| Example 15 | (2) | 0 | 1.0 | 1.0 | (6) | La | i-BTMS | 108 | 0.824 | 0.922 | 0.21 | 0.05 | D | B |
| Comparative Example 2 | (2) | 0 | 1.0 | 1.0 | (7) | — | i-BTMS | 80 | 0.888 | 0.916 | 0.15 | 0.05 | E | B |
| Example 16 | (3) | 1.0 | 0 | 1.0 | (1) | La | i-BTMS | 53 | 0.925 | 0.952 | 0.32 | 0.05 | A | B |
| Example 17 | (3) | 1.0 | 0 | 1.0 | (2) | La | i-BTMS | 25 | 0.938 | 0.973 | 0.82 | 0.05 | B | B |
| Example 18 | (3) | 1.0 | 0 | 1.0 | (3) | La | i-BTMS | 38 | 0.931 | 0.958 | 0.43 | 0.05 | A | B |
| Example 19 | (3) | 1.0 | 0 | 1.0 | (4) | La | i-BTMS | 81 | 0.903 | 0.932 | 0.31 | 0.05 | B | B |
| Example 20 | (3) | 1.0 | 0 | 1.0 | (5) | La | i-BTMS | 94 | 0.856 | 0.924 | 0.24 | 0.05 | C | B |
| Example 21 | (3) | 1.0 | 0 | 1.0 | (6) | La | i-BTMS | 108 | 0.824 | 0.922 | 0.21 | 0.05 | D | B |
| Comparative Example 3 | (3) | 1.0 | 0 | 1.0 | (7) | — | i-BTMS | 80 | 0.888 | 0.916 | 0.15 | 0.05 | E | B |
| Example 22 | (4) | 0 | 0.1 | 0.1 | (1) | La | i-BTMS | 53 | 0.925 | 0.952 | 0.32 | 0.05 | A | C |
| Example 23 | (4) | 0 | 0.1 | 0.1 | (2) | La | i-BTMS | 25 | 0.938 | 0.973 | 0.82 | 0.05 | B | C |
| Example 24 | (4) | 0 | 0.1 | 0.1 | (3) | La | i-BTMS | 38 | 0.931 | 0.958 | 0.43 | 0.05 | A | C |
| Example 25 | (4) | 0 | 0.1 | 0.1 | (4) | La | i-BTMS | 81 | 0.903 | 0.932 | 0.31 | 0.05 | B | C |
| Example 26 | (4) | 0 | 0.1 | 0.1 | (5) | La | i-BTMS | 94 | 0.856 | 0.924 | 0.24 | 0.05 | C | C |
| Example 27 | (4) | 0 | 0.1 | 0.1 | (6) | La | i-BTMS | 108 | 0.824 | 0.922 | 0.21 | 0.05 | D | C |
| Comparative Example 4 | (4) | 0 | 0.1 | 0.1 | (7) | — | i-BTMS | 80 | 0.888 | 0.916 | 0.15 | 0.05 | E | C |
| Example 28 | (5) | 0.1 | 0 | 0.1 | (1) | La | i-BTMS | 53 | 0.925 | 0.952 | 0.32 | 0.05 | A | C |
| Example 29 | (5) | 0.1 | 0 | 0.1 | (2) | La | i-BTMS | 25 | 0.938 | 0.973 | 0.82 | 0.05 | B | C |
| Example 30 | (5) | 0.1 | 0 | 0.1 | (3) | La | i-BTMS | 38 | 0.931 | 0.958 | 0.43 | 0.05 | A | C |
| Example 31 | (5) | 0.1 | 0 | 0.1 | (4) | La | i-BTMS | 81 | 0.903 | 0.932 | 0.31 | 0.05 | B | C |
| Example 32 | (5) | 0.1 | 0 | 0.1 | (5) | La | i-BTMS | 94 | 0.856 | 0.924 | 0.24 | 0.05 | C | C |
| Example 33 | (5) | 0.1 | 0 | 0.1 | (6) | La | i-BTMS | 108 | 0.824 | 0.922 | 0.21 | 0.05 | D | C |
| Comparative Example 5 | (5) | 0.1 | 0 | 0.1 | (7) | — | i-BTMS | 80 | 0.888 | 0.916 | 0.15 | 0.05 | E | C |
| Example 34 | (6) | 0 | 0.2 | 0.2 | (1) | La | i-BTMS | 53 | 0.925 | 0.952 | 0.32 | 0.05 | A | C |
| Example 35 | (6) | 0 | 0.2 | 0.2 | (2) | La | i-BTMS | 25 | 0.938 | 0.973 | 0.82 | 0.05 | B | C |
| Example 36 | (6) | 0 | 0.2 | 0.2 | (3) | La | i-BTMS | 38 | 0.931 | 0.958 | 0.43 | 0.05 | A | C |
| Example 37 | (6) | 0 | 0.2 | 0.2 | (4) | La | i-BTMS | 81 | 0.903 | 0.932 | 0.31 | 0.05 | B | C |
| Example 38 | (6) | 0 | 0.2 | 0.2 | (5) | La | i-BTMS | 94 | 0.856 | 0.924 | 0.24 | 0.05 | C | C |
| Example 39 | (6) | 0 | 0.2 | 0.2 | (6) | La | i-BTMS | 108 | 0.824 | 0.922 | 0.21 | 0.05 | D | C |
| Comparative Example 6 | (6) | 0 | 0.2 | 0.2 | (7) | — | i-BTMS | 80 | 0.888 | 0.916 | 0.15 | 0.05 | E | C |

TABLE 4

| | Resin-coated ferrite particles | | | | Strontium titanate particles | | | | | | | | Image evaluation | |
|---|---|---|---|---|---|---|---|---|---|---|---|---|---|---|
| | Ferrite particles | | | | | | | | | | | | | |
| | Type — | Sr % by mass | Ca % by mass | Total % by mass | Type — | Dopant — | Surface treatment agent — | Average primary particle diameter nm | Average circularity — | 84% cumulative circularity — | Half width of (110) peak ° | Amount added externally % by mass | Fog-ging | Fine line repro-ducibility |
| Example 40 | (7) | 0.2 | 0 | 0.2 | (1) | La | i-BTMS | 53 | 0.925 | 0.952 | 0.32 | 0.05 | A | C |
| Example 41 | (7) | 0.2 | 0 | 0.2 | (2) | La | i-BTMS | 25 | 0.938 | 0.973 | 0.82 | 0.05 | B | C |
| Example 42 | (7) | 0.2 | 0 | 0.2 | (3) | La | i-BTMS | 38 | 0.931 | 0.958 | 0.43 | 0.05 | A | C |

TABLE 4-continued

| | Resin-coated ferrite particles | | | | Strontium titanate particles | | | | | | | | Image evaluation | |
|---|---|---|---|---|---|---|---|---|---|---|---|---|---|---|
| | Ferrite particles | | | | | | | | | | | | | |
| | Type — | Sr % by mass | Ca % by mass | Total % by mass | Type — | Dopant — | Surface treatment agent — | Average primary particle diameter nm | Average circularity — | 84% cumulative circularity — | Half width of (110) peak ° | Amount added externally % by mass | Fog-ging | Fine line repro-ducibility |
| Example 43 | (7) | 0.2 | 0 | 0.2 | (4) | La | i-BTMS | 81 | 0.903 | 0.932 | 0.31 | 0.05 | B | C |
| Example 44 | (7) | 0.2 | 0 | 0.2 | (5) | La | i-BTMS | 94 | 0.856 | 0.924 | 0.24 | 0.05 | C | C |
| Example 45 | (7) | 0.2 | 0 | 0.2 | (6) | La | i-BTMS | 108 | 0.824 | 0.922 | 0.21 | 0.05 | D | C |
| Comparative Example 7 | (7) | 0.2 | 0 | 0.2 | (7) | — | i-BTMS | 80 | 0.888 | 0.916 | 0.15 | 0.05 | E | C |
| Example 46 | (8) | 0 | 0.6 | 0.6 | (1) | La | i-BTMS | 53 | 0.925 | 0.952 | 0.32 | 0.05 | A | B |
| Example 47 | (8) | 0 | 0.6 | 0.6 | (2) | La | i-BTMS | 25 | 0.938 | 0.973 | 0.82 | 0.05 | B | B |
| Example 48 | (8) | 0 | 0.6 | 0.6 | (3) | La | i-BTMS | 38 | 0.931 | 0.958 | 0.43 | 0.05 | A | B |
| Example 49 | (8) | 0 | 0.6 | 0.6 | (4) | La | i-BTMS | 81 | 0.903 | 0.932 | 0.31 | 0.05 | B | B |
| Example 50 | (8) | 0 | 0.6 | 0.6 | (5) | La | i-BTMS | 94 | 0.856 | 0.924 | 0.24 | 0.05 | C | B |
| Example 51 | (8) | 0 | 0.6 | 0.6 | (6) | La | i-BTMS | 108 | 0.824 | 0.922 | 0.21 | 0.05 | D | B |
| Comparative Example 8 | (8) | 0 | 0.6 | 0.6 | (7) | — | i-BTMS | 80 | 0.888 | 0.916 | 0.15 | 0.05 | E | B |
| Example 52 | (9) | 0 | 1.5 | 1.5 | (1) | La | i-BTMS | 53 | 0.925 | 0.952 | 0.32 | 0.05 | A | B |
| Example 53 | (9) | 0 | 1.5 | 1.5 | (2) | La | i-BTMS | 25 | 0.938 | 0.973 | 0.82 | 0.05 | B | B |
| Example 54 | (9) | 0 | 1.5 | 1.5 | (3) | La | i-BTMS | 38 | 0.931 | 0.958 | 0.43 | 0.05 | A | B |
| Example 55 | (9) | 0 | 1.5 | 1.5 | (4) | La | i-BTMS | 81 | 0.903 | 0.932 | 0.31 | 0.05 | B | B |
| Example 56 | (9) | 0 | 1.5 | 1.5 | (5) | La | i-BTMS | 94 | 0.856 | 0.924 | 0.24 | 0.05 | C | B |
| Example 57 | (9) | 0 | 1.5 | 1.5 | (6) | La | i-BTMS | 108 | 0.824 | 0.922 | 0.21 | 0.05 | D | B |
| Comparative Example 9 | (9) | 0 | 1.5 | 1.5 | (7) | — | i-BTMS | 80 | 0.888 | 0.916 | 0.15 | 0.05 | E | B |
| Example 58 | (10) | 1.0 | 1.0 | 2.0 | (1) | La | i-BTMS | 53 | 0.925 | 0.952 | 0.32 | 0.05 | A | B |
| Example 59 | (10) | 1.0 | 1.0 | 2.0 | (2) | La | i-BTMS | 25 | 0.938 | 0.973 | 0.82 | 0.05 | B | B |
| Example 60 | (10) | 1.0 | 1.0 | 2.0 | (3) | La | i-BTMS | 38 | 0.931 | 0.958 | 0.43 | 0.05 | A | B |
| Example 61 | (10) | 1.0 | 1.0 | 2.0 | (4) | La | i-BTMS | 81 | 0.903 | 0.932 | 0.31 | 0.05 | B | B |
| Example 62 | (10) | 1.0 | 1.0 | 2.0 | (5) | La | i-BTMS | 94 | 0.856 | 0.924 | 0.24 | 0.05 | C | B |
| Example 63 | (10) | 1.0 | 1.0 | 2.0 | (6) | La | i-BTMS | 108 | 0.824 | 0.922 | 0.21 | 0.05 | D | B |
| Comparative Example 10 | (10) | 1.0 | 1.0 | 2.0 | (7) | — | i-BTMS | 80 | 0.888 | 0.916 | 0.15 | 0.05 | E | B |
| Example 64 | (11) | 0 | 2.0 | 2.0 | (1) | La | i-BTMS | 53 | 0.925 | 0.952 | 0.32 | 0.05 | A | C |
| Example 65 | (11) | 0 | 2.0 | 2.0 | (2) | La | i-BTMS | 25 | 0.938 | 0.973 | 0.82 | 0.05 | B | C |
| Example 66 | (11) | 0 | 2.0 | 2.0 | (3) | La | i-BTMS | 38 | 0.931 | 0.958 | 0.43 | 0.05 | A | C |
| Example 67 | (11) | 0 | 2.0 | 2.0 | (4) | La | i-BTMS | 81 | 0.903 | 0.932 | 0.31 | 0.05 | B | C |
| Example 68 | (11) | 0 | 2.0 | 2.0 | (5) | La | i-BTMS | 94 | 0.856 | 0.924 | 0.24 | 0.05 | C | C |
| Example 69 | (11) | 0 | 2.0 | 2.0 | (6) | La | i-BTMS | 108 | 0.824 | 0.922 | 0.21 | 0.05 | D | C |
| Comparative Example 11 | (11) | 0 | 2.0 | 2.0 | (7) | — | i-BTMS | 80 | 0.888 | 0.916 | 0.15 | 0.05 | E | C |
| Example 70 | (12) | 2.0 | 0 | 2.0 | (1) | La | i-BTMS | 53 | 0.925 | 0.952 | 0.32 | 0.05 | A | C |
| Example 71 | (12) | 2.0 | 0 | 2.0 | (2) | La | i-BTMS | 25 | 0.938 | 0.973 | 0.82 | 0.05 | B | C |
| Example 72 | (12) | 2.0 | 0 | 2.0 | (3) | La | i-BTMS | 38 | 0.931 | 0.958 | 0.43 | 0.05 | A | C |
| Example 73 | (12) | 2.0 | 0 | 2.0 | (4) | La | i-BTMS | 81 | 0.903 | 0.932 | 0.31 | 0.05 | B | C |
| Example 74 | (12) | 2.0 | 0 | 2.0 | (5) | La | i-BTMS | 94 | 0.856 | 0.924 | 0.24 | 0.05 | C | C |
| Example 75 | (12) | 2.0 | 0 | 2.0 | (6) | La | i-BTMS | 108 | 0.824 | 0.922 | 0.21 | 0.05 | D | C |
| Comparative Example 12 | (12) | 2.0 | 0 | 2.0 | (7) | — | i-BTMS | 80 | 0.888 | 0.916 | 0.15 | 0.05 | E | C |
| Example 76 | (13) | 0 | 2.5 | 2.5 | (1) | La | i-BTMS | 53 | 0.925 | 0.952 | 0.32 | 0.05 | B | D |
| Example 77 | (14) | 2.5 | 0 | 2.5 | (1) | La | i-BTMS | 53 | 0.925 | 0.952 | 0.32 | 0.05 | B | D |
| Example 78 | (15) | 1.2 | 1.2 | 2.4 | (1) | La | i-BTMS | 53 | 0.925 | 0.952 | 0.32 | 0.05 | B | D |
| Example 79 | (16) | 0 | 0.05 | 0.05 | (1) | La | i-BTMS | 53 | 0.925 | 0.952 | 0.32 | 0.05 | B | D |
| Example 80 | (17) | 0.05 | 0 | 0.05 | (1) | La | i-BTMS | 53 | 0.925 | 0.952 | 0.32 | 0.05 | B | D |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A carrier for electrostatic image development, the carrier comprising:

resin-coated magnetic particles each including a magnetic particle and a resin layer that covers the magnetic particle; and strontium titanate particles, wherein the strontium titanate particles are composed of primary particles having an average circularity of 0.82 to 0.94 and an 84% cumulative circularity of more than 0.92, wherein the strontium titanate particles in which a half width of a (110) peak obtained by an X-ray diffraction method is 0.2° to 2.0°, wherein the strontium titanate particles have an average primary particle diameter of 15 nm to 60 nm.

2. The carrier for electrostatic image development according to claim 1, wherein the strontium titanate particles contain a dopant.

3. The carrier for electrostatic image development according to claim 1, wherein the amount of the strontium titanate particles with respect to the mass of the resin-coated magnetic particles is 0.02% by mass to 0.08% by mass.

4. The carrier for electrostatic image development according to claim 1, wherein the ratio of exposed surfaces of the magnetic particles on the surfaces of the resin-coated magnetic particles is 2% to 20%.

5. The carrier for electrostatic image development according to claim 1, wherein the magnetic particles are ferrite particles.

6. The carrier for electrostatic image development according to claim 5, wherein the ferrite particles contain at least one selected from calcium oxide and strontium oxide, and the total content of a calcium element and a strontium element in the ferrite particles is 0.1% by mass to 2.0% by mass.

7. An electrostatic image developer comprising:

a toner for electrostatic image development; and the carrier for electrostatic image development according to claim 1.

* * * * *